US009610626B2

(12) United States Patent
Nozu et al.

(10) Patent No.: US 9,610,626 B2
(45) Date of Patent: Apr. 4, 2017

(54) PIPE BEND DIE UNIT, AND PIPE BENDING APPARATUS HAVING THE UNIT

(71) Applicant: SANGO CO., LTD., Miyoshi-shi, Aichi-ken (JP)

(72) Inventors: Kentaro Nozu, Nagakute (JP); Koji Suzuki, Nisshin (JP); Masashi Ota, Kariya (JP)

(73) Assignee: SANGO CO., LTD., Miyoshi-Shi, Aichi-Ken (JP)

( * ) Notice: Subject to any disclaimer, the term of this patent is extended or adjusted under 35 U.S.C. 154(b) by 0 days.

(21) Appl. No.: 15/033,500

(22) PCT Filed: Nov. 13, 2015

(86) PCT No.: PCT/JP2015/081929
§ 371 (c)(1),
(2) Date: Apr. 29, 2016

(87) PCT Pub. No.: WO2016/103964
PCT Pub. Date: Jun. 30, 2016

(65) Prior Publication Data

US 2016/0354823 A1 Dec. 8, 2016

(30) Foreign Application Priority Data

Dec. 26, 2014 (JP) ..... 2014-264011

(51) Int. Cl.
*B21D 7/02* (2006.01)
*B21D 7/025* (2006.01)

(52) U.S. Cl.
CPC ..... *B21D 7/025* (2013.01)

(58) Field of Classification Search
CPC ..... B21D 7/02; B21D 7/022; B21D 7/024; B21D 7/025; B21D 7/04; B21D 9/073
See application file for complete search history.

(56) References Cited

U.S. PATENT DOCUMENTS 5,337,590 A 8/1994 Schuchert et al.
6,009,737 A 1/2000 Bandy
2008/0110223 A1* 5/2008 Zuber ..... B21D 7/024 72/309

FOREIGN PATENT DOCUMENTS

JP 52-71368 A 6/1977
JP 04-83418 U 7/1992
(Continued)

OTHER PUBLICATIONS

International Search Report (PCT/ISA/210) issued on Dec. 15, 2015, by the Japanese Patent Office as the International Searching Authority for International Application No. PCT/JP2015/081929.
(Continued)

*Primary Examiner* — Debra Sullivan
(74) *Attorney, Agent, or Firm* — Buchanan Ingersoll & Rooney PC

(57) ABSTRACT

A bend die comprises a clamp member having a first groove part of half-circular cross section on its outer peripheral surface with a fitting recess formed on the first groove part and extending in a peripheral direction by a first predetermined length on a planar surface perpendicular to a rotary axis, and a counter pressure member having a second groove part of half-circular cross section formed on its outer peripheral surface, and a fitting protrusion extending in a peripheral direction by a second predetermined length from a tip end portion of the second groove part. The fitting protrusion is positioned in the fitting recess so that a pipe-receiving groove of half-circular cross section is formed. The first and second groove parts are hingedly connected to one another about the rotary axis so as to be rotated relative to each other.

13 Claims, 19 Drawing Sheets

(56) References Cited

FOREIGN PATENT DOCUMENTS

| | | | |
|---|---|---|---|
| JP | 06-182450 | A | 7/1994 |
| JP | 11-512029 | A | 10/1999 |
| JP | 2004-009125 | A | 1/2004 |
| JP | 2008-246504 | A | 10/2008 |
| JP | 2010-167470 | A | 8/2010 |
| JP | 2012-055952 | A | 3/2012 |

OTHER PUBLICATIONS

Written Opinion (PCT/ISA/237) issued on Dec. 15, 2015, by the Japanese Patent Office as the International Searching Authority for International Application No. PCT/JP2015/081929.
Office Action (Notice of Ground of Rejection) issued on Dec. 22, 2015, by the Japanese Patent Office in corresponding Japanese Patent Application No. 2015-561455, and an English Translation of the Office Action.
Notice of Allowance issued on Feb. 5, 2016 by the Japanese Patent Office in corresponding Japanese Patent Application No. 2015-561455, and an English Translation of Notice of Allowance.

* cited by examiner

PIPE BEND DIE UNIT, AND PIPE BENDING APPARATUS HAVING THE UNIT

TECHNICAL FIELD

The present invention relates to a pipe bend die unit that is appropriate for bending a pipe, and a pipe bending apparatus having the unit.

BACKGROUND ART

As for working to bend a pipe, various kinds of working such as press bending, compression bending, extract bending, draw bending and the like are known heretofore, among which a rotary draw bending is most popular. According to an ordinary rotary draw bending, a pipe is held by a clamp die against a bend die with a groove formed on its outer peripheral surface, and the bend die and clamp die are rotated, with the pipe being pressed toward the bend die by means of a pressure die, then the pipe is moved in a tangential direction, thereby to be bent along the groove of the bend die, as disclosed in the second column of Patent document 1, for example, and also disclosed in Patent document 2, in its paragraphs (0003)-(0006) and FIG. 11, wherein the bend die is described as a roll die.

In Patent document 2, with respect to a wiper or shoe provided for preventing a crinkling from being created on the inner side of a bent portion of the pipe, a specific wiper is proposed to do with wear or breakage caused by a sliding motion, as described in its paragraphs (0013) and (0014). Likewise, in Patent document 3, it is described in its paragraph (0005) as an object to provide a pipe bending apparatus having a wear resistance, being used for various kinds of pipes without causing a problem, and having a very long life without requiring adjusting operations very often, and such a pipe bending apparatus is proposed in its paragraph (0006) that is characterized in that the pipe bending apparatus has a bend die with its outer peripheral surface formed in a circular arc of a predetermined curvature to bend a pipe, a clamp member clamping the pipe with the bend die, and a wiper rotating the clamp member about the bend die to prevent a crinkling from being created when the pipe is bent, and that a tip end portion of the wiper in the rotating direction of the clamp member is extended along the curvature of the outer peripheral surface of the bend die beyond an initial point for bending the pipe.

Furthermore, in Patent document 4, with respect to a method and apparatus for quickly and accurately changing die sets for different-sized tubing to be bent or for different types of tube bending operations, it is described in its page 7 that a preassembled die set has been devised for tube bending apparatus wherein the die set is comprised of a bend die, clamp die and pressure die adapted to be mounted on a spindle of a tube bending table, the improvement comprising first means releasably interconnecting the pressure die and clamp die to the bend die in predetermined, aligned relation to one another and to the bend die, and handling means for engaging the die set in order to simultaneously lift and remove said dies comprising each die set from the table. And, it is described in its page 8 that many tube bending operations require the use of a wiper die and mandrel, which may also provide a part of each preassembled die set when needed, and such an embodiment that the wiper die is joined to the bend die by a wiper die arm is disclosed in its page 15 and FIG. 6.

Furthermore, in Patent document 5, there is disclosed "a bending apparatus with a wiper die retreating mechanism to avoid an interference with a chuck by retreating the wiper die", and it is proposed in its paragraphs (0001) and (0006) to provide a bending apparatus clamping an elongated work by a chuck of a carriage moving the work in an axial direction to supply it, squeezing the work by a bend die adapted to a bending shape and a clamp die opposing to the bend die, holding the work by a wiper die adjacent to the bend die and a pressure die opposing to the wiper die, and bending the work in accordance with a rotation of the bend die, that is characterized in comprising a swinging member which is supported rotatably around a fixed shaft and driven to be swung, a fixed gear fixed to the fixed shaft, an idle gear meshed with the fixed gear to be supported rotatably on the swinging member, and a driven gear having the same number of teeth as the fixed gear, and being meshed with the idle gear to be supported rotatably on the swinging member, and wherein the wiper die is attached to the driven gear. Likewise, in Patent document 6, there is disclosed "a die retrieving device for use in a tube bending apparatus".

PRIOR ART DOCUMENT

Patent Document

Patent document 1: U.S. Pat. No. 5,337,590
Patent document 2:
Japanese Patent Laid-open Publication No. 2004-9125
Patent document 3:
Japanese Patent Laid-open Publication No. 2008-246504
Patent document 4:
Japanese Patent Laid-open Publication No. Hei-11-512029
Patent document 5:
Japanese Patent Laid-open Publication No. Hei-6-182450
Patent document 6:
Japanese Utility model Laid-open Publication No. Hei-4-83418

SUMMARY OF THE INVENTION

Problems to be Solved by the Invention

Although it is configured to form the crinkling intentionally in Patent document 1, in order to prevent the crinkling from being created when the draw rotary bending is performed, a crinkling prevention is employed in general, so that the wiper is disposed in Patent documents 2, 3 and 4. Among them, each wiper as described in Patent documents 2 and 4 has a tip end portion formed into a wedge shape, and possible wear of the tip edge portion was concerned in Patent document 2, so that a counter measure has been considered. Particularly, there is a step along an initial line for bending the pipe, normally a line where a surface including a rotary axis of the bend die intersects an inner surface of a groove of the bend die, a crinkling resulted from the step cannot be avoided. In order to minimize this crinkling, it is necessary to maintain the wedge shape of the tip end portion of the wiper, especially necessary to make the tip end portion as thinner as possible, so that the wiper is fragile and lacks its durability. Furthermore, a periodic wear countermeasure is unavoidable, and frequent replacements are required. In addition, as an initial setting for the bending is difficult, skilled technique is required. Therefore, it is difficult to perform a large amount of bending operations continuously.

In contrast, according to Patent document 3, a wiper disclosed as one embodiment therein configures a part of a central die section out of bending die sections which were divided into three sections along a vertical direction, and it is formed with a recess portion of a circular arc cross section, as described in its Paragraphs (0025)-(0030). Consequently, it is described in its Paragraph (0032) that a tip end portion with an edge structure is not required, and that there will be no possibility for creating a step between the bend die and the wiper, the reason of which has not been explained. Supposing that, from a start to an end of bending operation applied to a pipe to be formed, out of the bending die sections divided into three sections along three planar surfaces parallel to a pipe axis, upper and lower side die sections perform the bending, and the central section performs as the wiper, thereby to perform separate operations, not only it is difficult to prevent the crinkling from being created, but also it is difficult to perform the bending operation appropriately. No disclosure can be found about a configuration for enabling a desired bending operation.

In the meantime, although it is described in Patent document 4 that the die set with the bend die, clamp die and pressure die being preassembled can be changed to perform bending operations in different forms, as described in its Page 11, a wiper die is not necessarily required. In other words, Patent document 4 focuses on a performance of changing dies, but never discloses such a die set that can change dies with the performance of appropriately preventing the crinkling from being created, nor discloses a pipe bend die unit that is appropriate for bending a pipe and a pipe bending apparatus having the pipe bend die unit.

Furthermore, although Patent documents 5 and 6 disclose the wiper die and the device for retrieving the wiper die, both are subject to a so-called wiper, and the retrieving mechanism is complicated in its structure, so that a desired accuracy can not be expected, and that its reproducibility is poor.

Accordingly, it is an object of the present invention to provide a pipe bend die unit that can perform bending a pipe appropriately without creating a crinkling. And, it is another object of the present invention to provide a pipe bending apparatus having the pipe bend die unit which is appropriate for the bending.

It is a further object of the present invention to provide a pipe bend die unit that can perform bending a pipe appropriately without creating a crinkling, and perform changing dies easily, and to provide a pipe bending apparatus having the unit.

Means for Solving the Problems

To solve the above-described problems, the pipe bend die unit of the present invention comprises a bend die with a pipe-receiving groove of half-circular cross section formed on an outer peripheral surface of the bend die, the bend die being rotatable about a rotary axis, and the bend die comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another about the rotary axis, and supported so as to be rotatable relative to each other about the rotary axis, and the counter pressure member being supported to be rotatable about the rotary axis in a direction spaced from a position where a bending operation of the pipe is initiated, and held between the position where the bending operation of the pipe is initiated and a predetermined retracted position to be spaced from the position where the bending operation is initiated.

In the pipe bend die unit as described above, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated. Or, it may be so configured that a fitting portion of the fitting protrusion that is positioned in the fitting recess is located at a foreside in an advancing direction of the pipe relative to a position where a bending operation of the pipe is initiated, and that a mating portion at which the first groove part of the clamp member and the second groove part of the counter pressure member mate is located at a backside in the advancing direction of the pipe relative to the position where the bending operation of the pipe is initiated.

It may be so configured that the counter pressure member has an annular rotary support portion mounted to be rotatable about the rotary axis, and that a part of the rotary support portion forms the fitting protrusion, and that the rotary support portion possesses an outer peripheral surface, the outer peripheral surface of the rotary support portion being a curved surface forming a part of the pipe-receiving groove of half-circular cross section. Also, it may be so configured that the counter pressure member and the clamp member are hingedly connected by an axial member having a central axis passing through the fitting recess.

In the pipe bend die unit as described above, the position where the bending operation of the pipe is initiated may be provided to be a desired initial position of the counter pressure member. In addition, the pipe bend die unit may further comprise a driving device that holds the counter pressure member at a desired position between the position where the bending operation is initiated and the retracted position.

Also, the present invention is to provide a pipe bending apparatus that comprises a bend die having a pipe-receiving groove of half-circular cross section on an outer peripheral surface of the bend die, the bend die being rotatable about a rotary axis, a clamp die for clamping a pipe to be bent with the groove of the bend die, and a pressure die for pressing the pipe toward the bend die, and that the bend die comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another about the rotary axis, and supported so as to be rotatable relative to each other about the rotary axis, and the counter pressure member being supported to be rotatable about the rotary axis in a direction spaced from a position where a bending operation of the pipe is initiated, and held between the position where the bending operation of the pipe is initiated and a predetermined retracted position to be spaced from the position where the bending operation is initiated, to configure a pipe bend die unit.

In the pipe bending apparatus as described above, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated.

Furthermore, it may be so configured that the counter pressure member has an annular rotary support portion mounted to be rotatable about the rotary axis, and that a part of the rotary support portion forms the fitting protrusion, and the rotary support portion possesses an outer peripheral surface, the outer peripheral surface of the rotary support portion being a curved surface forming a part of the pipe-receiving groove of half-circular cross section.

In the pipe bending apparatus as described above, it may be so configured that the initial position where the bending operation of the pipe is initiated may be provided to be a desired initial position of the counter pressure member. In addition, it may further comprise a driving device that holds the counter pressure member at the desired position between the initial position and the retracted position.

Furthermore, in the pipe bending apparatus as described above, it may further comprise a mandrel with a tip end portion thereof being inserted into the pipe, the mandrel being driven such that the tip end portion opposes the pressure die within a predetermined rotating region of the bend die.

Effects of the Invention

As the present invention is configured as described above, the following effects can be achieved. That is, according to the pipe bend die unit of the present invention, the bend die configuring it comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another about the rotary axis, and supported so as to be rotatable relative to each other about the rotary axis. Therefore, the bending of the pipe can be achieved appropriately without causing the crinkling. Furthermore, if a plurality of pipe bend die units are prepared in accordance with various shapes of pipes to be bent, when a pipe is to be bent in a shape, a pipe bend die unit for the shape to be bent may be simply selected and changed, so that may be provided such a pipe bend die unit that die change can be performed easily, and that no adjustment is required after the die change.

Particularly, as it is configured that the counter pressure member is supported to be rotatable about the rotary axis in a direction spaced from a position where a bending operation of the pipe is initiated, and held between the position where the bending operation of the pipe is initiated and a predetermined retracted position to be spaced from the position where the bending operation is initiated, in the case where a pipe forward driving mechanism, for example, might interfere with the counter pressure member, when a bending operation of the pipe is performed, the counter pressure member can be easily retracted to be held at a desired position. Therefore, it is not required to cut out an unnecessary part of an elongated pipe, after it was bent, so that not only a cutting process will become unnecessary, but also a yield rate of a member for configuring the pipe will be improved. In addition, the retracted position of the counter pressure member can be set at a high accuracy, and a good reproducibility can be obtained.

In the pipe bend die unit as described above, if such a configuration is employed that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, or if such a configuration is employed that a fitting portion of the fitting protrusion positioned in the fitting recess is located at a foreside in an advancing direction of the pipe relative to a position where a bending operation of the pipe is initiated, and a mating portion at which the first groove part of the clamp member and the second groove part of the counter pressure member mate is located at a backside of the advancing direction of the pipe relative to the position where the bending operation of the pipe is initiated, smooth bending of the pipe can be achieved without causing the crinkling.

If the counter pressure member is formed to have an annular rotary support portion mounted to be rotatable about the rotary axis, it can be surely supported to be rotatable about the rotary axis. Particularly, it can be hingedly connected with the clamp member easily, and, if it is so configured that a part of the rotary support portion forms the fitting protrusion, and that an outer peripheral surface of the rotary support portion is a curved surface forming a part of the pipe-receiving groove of half-circular cross section, the counter pressure member can be formed as a single part with an appropriate shape. Also, if it is so configured that the counter pressure member and the clamp member are hingedly connected by an axial member having a central axis passing through the fitting recess, smooth bending of the pipe can be achieved without causing the crinkling.

In the pipe bend die unit as described above, if such a configuration is employed that the position where the bending operation of the pipe is initiated is provided to be a desired initial position of the counter pressure member, the position where the bending operation is initiated can be adjusted easily. Furthermore, if it is so configured to have a driving device that holds the counter pressure member at a desired position between the position where the bending operation is initiated and the retracted position, not only the position where the bending operation is initiated and the retracted position can be adjusted easily, but also their positional relationship during the bending operation can be adjusted easily.

And, the pipe bending apparatus according to the present invention comprises the pipe bend die unit configured as described before, a clamp die for clamping the pipe to be bent with the pipe-receiving groove of its bend die, and a pressure die for pressing the pipe toward the bend die, and bending of the pipe can be performed by rotating the bend die and the clamp die, with the pipe being pressed in the bending direction by the pressure die, so that the bending of the pipe can be achieved appropriately without causing the crinkling. Particularly, as it is configured that the counter pressure member is supported to be rotatable about the rotary axis in a direction spaced from a position where a bending operation of the pipe is initiated, and held between the position where the bending operation of the pipe is initiated and a predetermined retracted position to be spaced from the position where the bending operation is initiated, in the case where a pipe forward driving mechanism, for example, might interfere with the counter pressure member, when a bending operation of the pipe is performed, the counter pressure member can be easily retracted to be held at a desired position. Therefore, it is not required to cut out an unnecessary part of an elongated pipe, after it was bent, so that not only a cutting process will become unnecessary, but also a yield rate of a member for configuring the pipe will be improved. In addition, the retracted position of the counter pressure member can be set at a high accuracy, and a good reproducibility can be obtained.

Furthermore, if a plurality of pipe bend die units are prepared in accordance with various shapes of pipes to be bent, when a pipe is to be bent in a shape, a pipe bend die unit for the shape to be bent may be simply selected and changed, so that the die change can be performed easily, and that no adjustment is required after the die change. Therefore, an automatic die change by means of a robot can be made.

In the pipe bending apparatus as described above, if such a configuration is employed that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, or a fitting portion of the fitting protrusion that is positioned in the fitting recess is located at a foreside in an advancing direction of the pipe relative to a position where a bending operation of the pipe is initiated, and a mating portion at which the first groove part of the clamp member and the second groove part of the counter pressure member mate is located at a backside in the advancing direction of the pipe relative to the position where the bending operation of the pipe is initiated, smooth bending of the pipe can be achieved.

If the counter pressure member served for the pipe bending apparatus as described above has an annular rotary support portion mounted to be rotatable about the rotary axis, and if it is so configured that a part of the rotary support portion forms the fitting protrusion, and that the outer peripheral surface of the rotary support portion is a curved surface forming a part of the pipe-receiving groove of half-circular cross section, then, it can be surely supported to be rotatable about the rotary axis, and it can be hingedly connected with the clamp member easily. And, the counter pressure member can be formed as a single part with an appropriate shape.

Furthermore, if it is so configured that the position where the bending operation of the pipe is initiated is provided to be a desired initial position of the counter pressure member, the position where the bending operation is initiated can be adjusted easily. Furthermore, if it is so configured to have the above-described driving device, not only the position where the bending operation is initiated and the retracted position can be adjusted easily, but also their positional relationship during the bending operation can be adjusted easily.

In the pipe bending apparatus as described above, if it comprises a mandrel with a tip end portion thereof being inserted into the pipe, to be driven such that the tip end portion opposes the pressure die within a predetermined rotating region of the bend die, bending operation with a small bending radius can be made easily, and limit for bending the pipe can be improved at a large extent.

EMBODIMENTS FOR CARRYING OUT THE INVENTION

Figure 1:
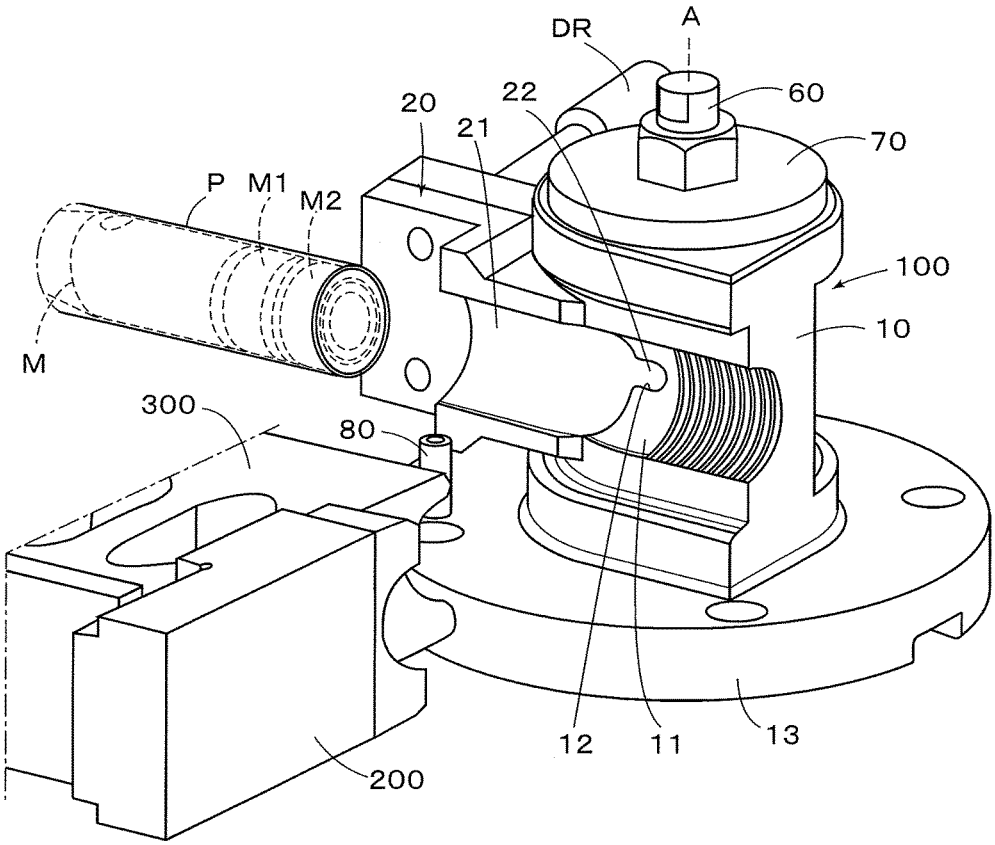
FIG. 1 is a perspective view showing a pipe bending apparatus according to an embodiment of the present invention.

Hereinafter, will be explained desirable embodiments of the present invention referring to drawings. FIG. 1 shows a pipe bend die unit according to an embodiment of the present invention, and shows a pipe bending apparatus further comprising a clamp die 200 and a pressure die 300 according to an embodiment of the present invention. The pipe bend die unit has a bend die 100, which is formed with a pipe-receiving groove of half-circular cross section (configured by first and second groove parts 11, 21 as will be described later), and which is rotated about a rotary axis (A). And, according to the pipe bending apparatus, it is so configured that a pipe (P) to be bent is clamped between the bend die 100 and the clamp die 200, and forwardly driven with being pressed toward the bend die 100 by the pressure die 300, thereby to bend the pipe (P) by means of compressing load and axially pressing load.

Figure 2:
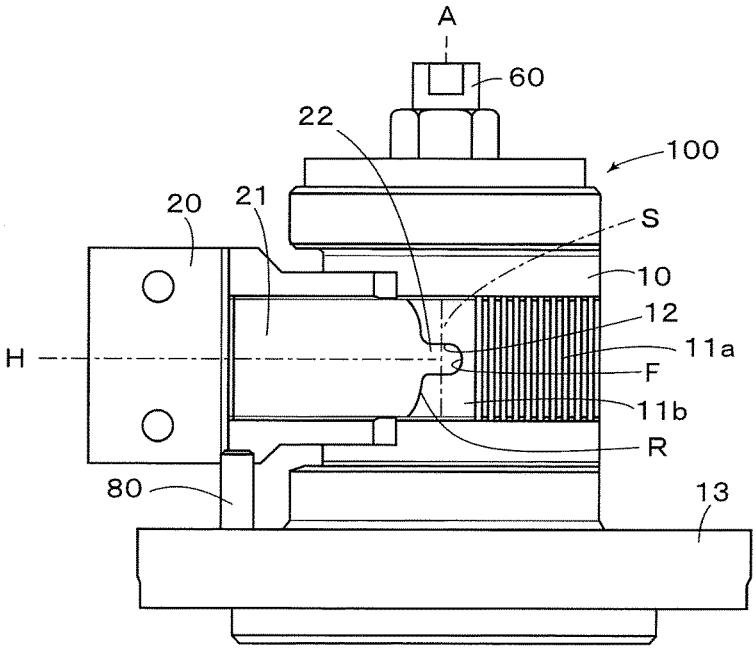
FIG. 2 is a front view of a pipe bend die unit according to an embodiment of the present invention.
Figure 3:
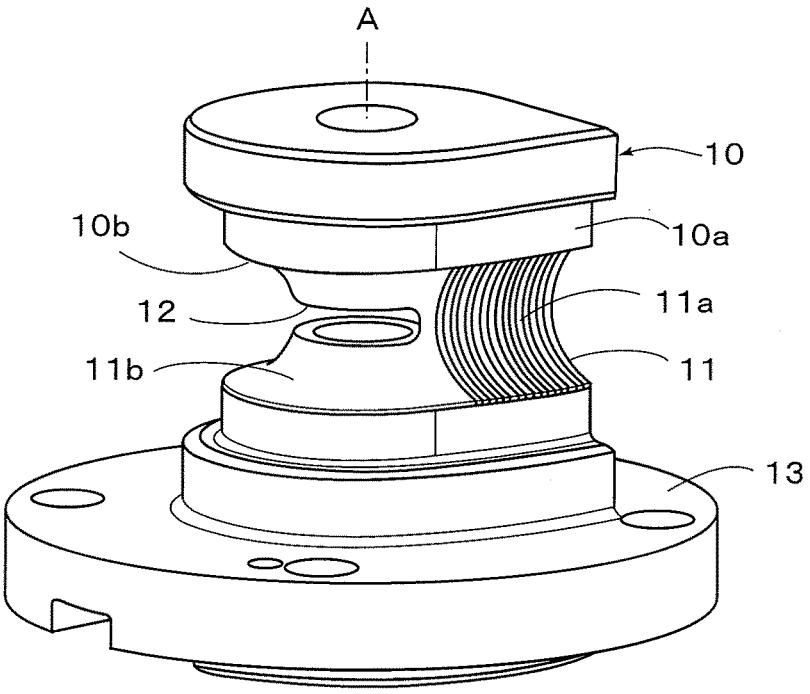
FIG. 3 is a perspective view showing a clamp member for use in a pipe bend die unit according to an embodiment of the present invention.

According to the present embodiment, the bend die 100 has a clamp member 10 and a counter pressure member 20. As shown in FIGS. 1 and 2, the clamp member 10 is formed with the first groove part 11 of half-circular cross section, and a fitting recess 12 of a predetermined width is formed on the first groove part 11 to extend in a peripheral direction by a predetermined length on a planar surface perpendicular to the rotary axis (A). And, the clamp member 10 is formed integrally with a base portion 13, to which an axial member 60 is fixed so as to provide the rotary axis (A), and a holding member 70 is fixed to the clamp member 10. Furthermore, a knock pin 80 is fixed to a predetermined position of the base portion 13, as will be described later. [0036] As shown in FIG. 3, the above-described clamp member 10 has a circularly recessed portion 10*b* to form the first groove part 11 of half-circular cross section, and the fitting recess 12 having a predetermined width and extending in a peripheral direction on a planar surface perpendicular to the rotary axis (A). The fitting recess 12 is located at the bottom center of the circularly recessed portion 10*b*. Accordingly, the first groove part 11 of half-circular cross section is continuous with the circularly recessed portion 10*b* including a part of the fitting recess 12. That is, the clamp member 10 has a clamp portion 10*a* for clamping the pipe (P), with a planar surface of the clamp portion 10*a* being connected to the clamp die 200, and the circularly recessed portion 10*b* formed continuously next to the clamp portion 10*a*, and a base portion 13 is formed integrally with the clamp portion 10*a* and the circularly recessed portion 10*b*.

Accordingly, the first groove part 11 possesses a continuous half-circular cross section, with a groove part 11*a* of half-circular cross section formed on the clamp portion 10*a* and a groove part 11*b* of half-circular cross section formed on the circularly recessed portion 10*b*. Furthermore, on the groove part 11*a*, a plurality of clamp grooves are formed peripherally in parallel to ensure holding the pipe (P), in the same manner as the inner peripheral surface of the clamp die 200.

Figure 5:
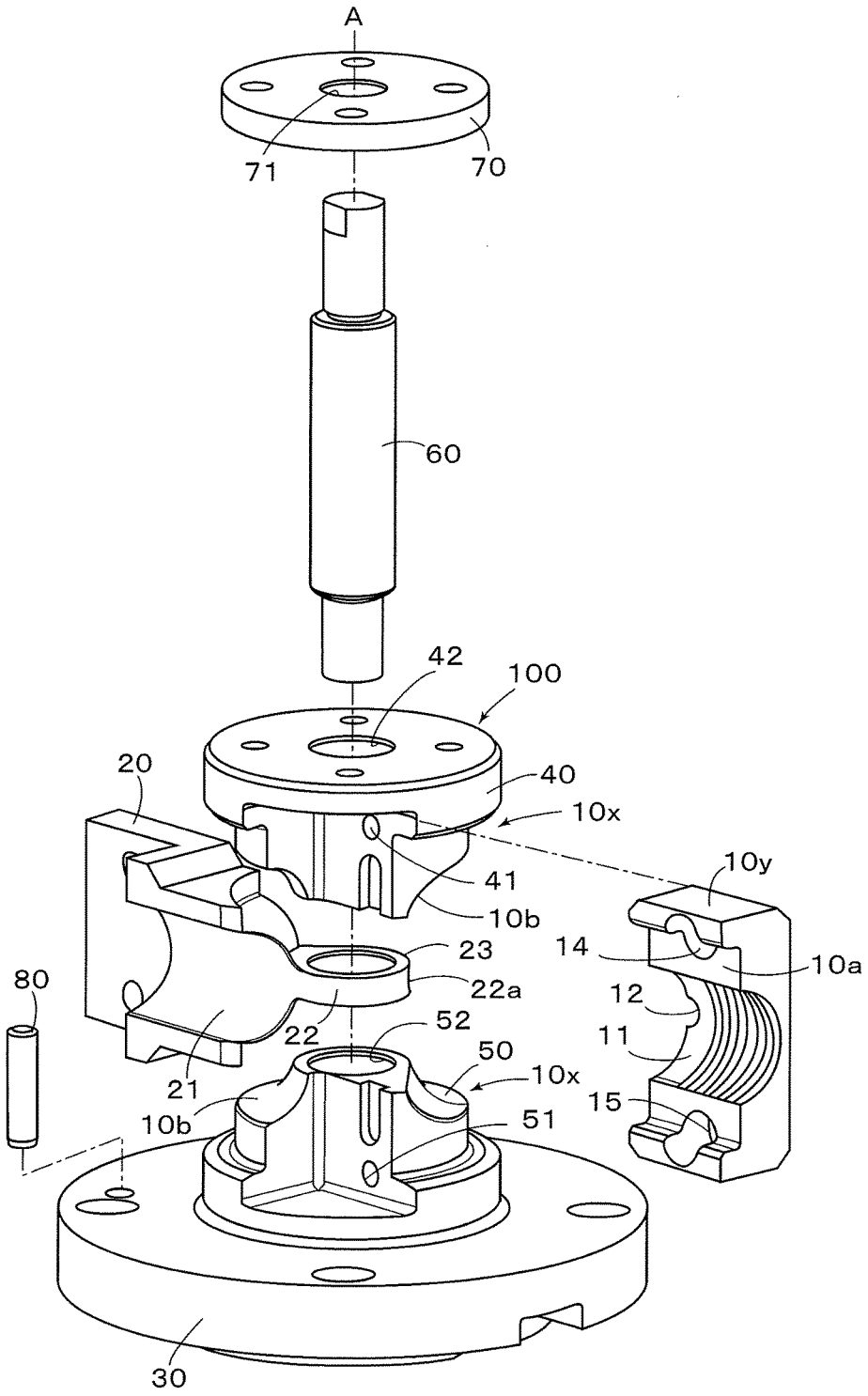
FIG. 5 is a perspective view of parts for assembling a pipe bend die unit according to an embodiment of the present invention.

In contrast to the clamp portion 10*a* that is formed integrally with the clamp member 10, the portion forming the clamp portion 10*a* may be made as a separate body (indicated by "10*y*" in FIG. 5 and so on), and connected to a main body 10 (indicated by "10*x*" in FIG. 5 and so on) configuring the circularly recessed portion 10*b*. For example, as shown in FIG. 5, the main body 10*x* is configured by an upper section 40 and a lower section 50, which are divided by a surface perpendicular to the rotary axis (A), and connected to a clamp portion 10*y* of the separate body, thereby to configure the clamp member 10. That is, as shown in its assembled state in FIG. 5, the axial member 60 is disposed to penetrate a center hole 42 of the upper section 40, the rotary support portion 23 of the counter pressure member 20 and a center hole 52 of the lower section 50, and, after an upper portion of the axial member 60 is penetrated through a center hole 71 of the holding member 70, the holding member 70 is fixed to the upper section 40. The clamp portion 10*y* is fixed to the main body 10*x* (the upper section 40 and lower section 50), with screws (not shown) being inserted from fixing holes 14 and 15, and meshed with screw holes 41 and 51 of the upper section 40 and lower section 50.

According to the embodiment as shown in FIG. 5, therefore, the clamp member 10 is configured by the main body 10*x*, which is configured by the upper section 40 and lower section 50, and the clamp portion 10*y*. The fitting recess 12 is configured by a cutout portion of the clamp portion 10*y*, and a clearance between the upper section 40 and lower section 50. With the fitting protrusion 22 of the counter pressure member 20 being positioned in the fitting recess 12, the bend die 100 is configured. Hereinafter, the clamp member 10 includes the one configured by the main body 10*x* and clamp portion 10*y*, except otherwise described specifically.

On the other hand, as shown in FIGS. 1 and 2, the counter pressure member 20 is formed with the second groove part 21 of half-circular cross section on its outer peripheral surface, and a fitting protrusion 22 extending in a peripheral direction by a predetermined length from a tip end portion of the second groove part 21. When the fitting protrusion 22 is positioned in the fitting recess 12, the pipe-receiving groove of half-circular cross section is formed by the combination of the first groove part 11 of the clamp member 10 and the second groove part 21 of the counter pressure member 20.

Figure 4:
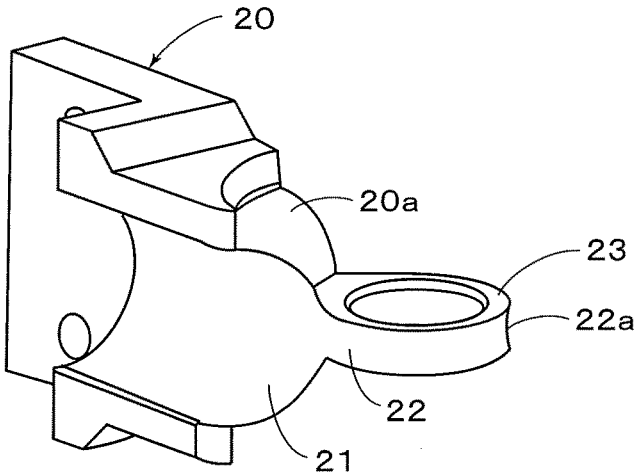
FIG. 4 is a perspective view showing a counter pressure member for use in a pipe bend die unit according to an embodiment of the present invention.

The above-described counter pressure member 20 is formed as shown in FIG. 4. That is, a curved surface portion (counter pressure portion) 20*a* positioned to be capable of contacting the circularly recessed portion 10*b* and the rotary support portion 23 rotatably supported about the rotary axis (A) are formed integrally, and a part of the rotary support portion 23 configures the fitting protrusion 22. Therefore, the outer peripheral surface of the rotary support portion 23 is formed into a curved surface, to form the pipe-receiving groove of half-circular cross section, together with the first groove part 11 of the clamp member 10. That is, the counter pressure member 20 is formed with a second groove part 21 of half-circular cross section, and the end surface of the second groove part 21 contacting the first groove part 11 of the clamp member 10 is formed to be curved according to its front view, as indicated by a contacting portion (R) in FIG. 2.

And, an outer peripheral surface 22*a* of the fitting protrusion 22, i.e., the outer peripheral surface of the rotary support portion 23 is formed into a curved surface as shown in FIG. 4. When the fitting protrusion 22 is positioned in the fitting recess 12 of the clamp member 10, thereby to form a part of the half-circular cross section of the first groove part 11 of the clamp member 10, the pipe-receiving groove of half-circular cross section is formed by them. The rotary support portion 23 of the present embodiment is made in an annular shape, while it may be made in C-shape, with a portion except for the fitting protrusion 22 being cut out to provide a space.

The clamp member 10 and counter pressure member 20 as configured above are hingedly connected about the rotary axis (A), and rotatably supported relative to each other about the axial member 60 (rotary axis (A)). According to the present embodiment, the clamp member 10 is supported to be rotated against the counter pressure member 20, which is fixed to a predetermined position of a support device (not shown). As shown in FIG. 2, the clamp member 10 and the counter pressure member 20 are hingedly connected, such that a fitting portion (F) of the fitting recess 12 fitted with the fitting protrusion 22, which portion (F) is not included on planar surfaces perpendicular to the rotary axis (A), i.e., two planar surfaces parallel to the plane perpendicular to the paper surface of FIG. 2 including (H) shown in FIG. 2, is located at a foreside (right side of (S) in FIG. 2) in an advancing direction of the pipe (P) relative to an initial position (indicated by a vertical one-dotted chain line (S) in FIG. 2) where a bending operation of the pipe (P) is initiated, and a mating portion (R) of the first groove part 11 of the clamp member 10 and the second groove part 21 of the counter pressure member 20 in a rotating direction is located at a backside (left side of (S) in FIG. 2) of the advancing direction of the pipe (P). In other words, the fitting portion (F) of the fitting protrusion 22 positioned in the fitting recess 12 in a rotating direction is located at the foreside in an advancing direction of the pipe (P) relative to the position where the bending operation of the pipe (P) is initiated, and the mating portion (R) of the first groove part 11 of the clamp member 10 and the second groove part 21 of the counter pressure member 20 in the rotating direction is located at a backside of the advancing direction of the pipe (P) relative to the position where the bending operation of the pipe (P) is initiated.

According to the present embodiment, the counter pressure member 20 has a curved surface portion 20*a*, which is formed on each of opposite sides of the planar surface that is perpendicular to the rotary axis (A) including the bottom center of the circularly recessed portion 10*b*, i.e., the planar surface including (H) as shown in FIG. 2 and corresponding to the paper surface of FIG. 2 (hereinafter, simply referred to as "planar surface (H)"), and which is configured to contact the circularly recessed portion 10*b*. The curved surface portion 20*a* possesses an arch center on an axis that is offset from the rotary axis (A) perpendicular to the planar surface (H) in a direction spaced from the rotary axis (A). Also, the counter pressure member 20 is formed with the second groove part 21 of half-circular cross section, with the bottom center of the second groove part 21 being provided on the planar surface (H), on its outer peripheral surface, and the fitting protrusion 22 extending in the peripheral direction by a predetermined length from the tip end portion of the second groove part 21. When the fitting protrusion 22 is positioned in the fitting recess 12, the pipe-receiving groove of half-circular cross section is formed by the first groove part 11 of the clamp member 10 and the second groove part 21 of the counter pressure member 20. Hereinafter, will be explained the configuration of the counter pressure member 20 including the rotary support portion 23, with reference to FIG. 7 and so on.

Figure 7:
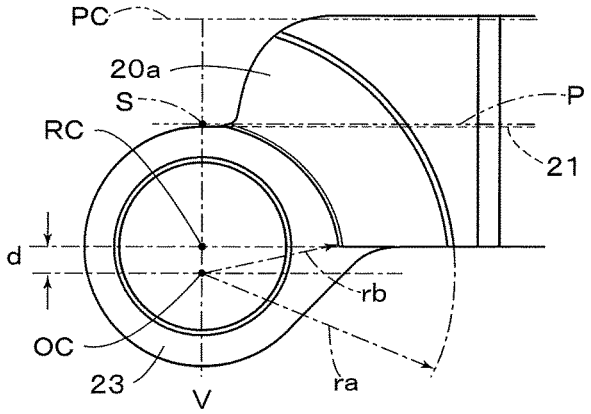
FIG. 7 is a plan view of a clamp member for use in an embodiment of the present invention.

As shown in FIG. 7, the curved surface portion 20*a* is provided on the opposite sides of the above planar surface (H) corresponding to the paper surface of FIG. 7, and its arch center is provided on an axis (OC), which is offset from the rotary axis (A) perpendicular to the planar surface (H) in the direction spaced from the rotary axis (A). The axis (RC) as shown in FIG. 7 corresponds to the rotary axis (A). In FIG. 7, on the second groove part 21 of the half-circular cross section as indicated by a broken line, there is positioned the pipe (P) having a center axis (PC) thereof as indicate by a two-dotted chain line, so that the axis (RC) and axis (OC) are positioned on a one dotted chain line (V) including the position (S) where the bending operation of the pipe (P) is initiated and extending vertically, and that the distance between the axes corresponds to the offset amount (d). In FIG. 7, although only the curved surface portion 20*a* formed at one side relative to the planar surface (H) appears, the other curved surface portion of the same shape with the curved surface portion 20*a* is formed at the other side, i.e., the reverse side of the paper surface of FIG. 7.

Figure 8:
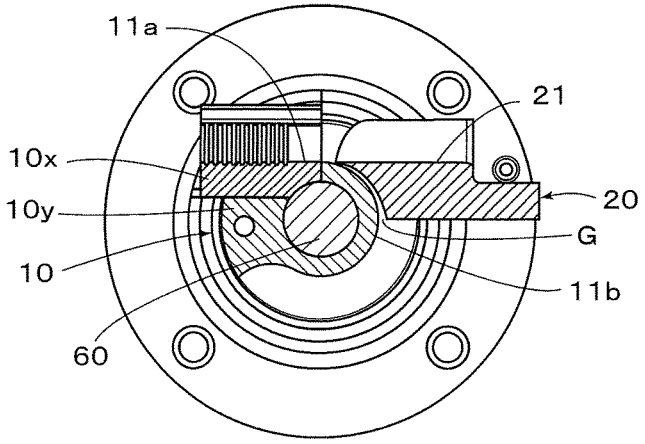
FIG. 8 is a partially sectioned view of a pipe bend die unit showing a state thereof where a bending operation is initiated, according to an embodiment of the present invention.

Particularly, the curved surface portion 20*a* has a maximum arch of radius (ra) and minimum arch of radius (rb) about the axis (OC) as each arch center, as shown in FIG. 7, and formed to expand so as to provide the curved surface to be capable of contacting the first groove part 11 of half-circular cross section (at the position where the operation is initiated). That is, as shown in FIG. 8, at the position (S) where the bending operation of the pipe (P) is initiated, the fitting protrusion 22 and the curved surface portion 20*a* contact the whole surface of the circularly recessed portion 10*b* (first groove part 11), and at the position spaced from the plane (H), a clearance (indicated by "G" in FIG. 8) is formed between the curved surface portion 20*a* and the circularly recessed portion 10*b*. FIG. 8 shows a sectional view at the position spaced from the plane (H) by a predetermined distance, i.e., at the position spaced from the plane including the central axis (PC) in FIG. 7 toward the reverse side (downward in FIG. 2), by a predetermined distance.

Accordingly, the tip end portion of the curved surface portion 20*a* of the counter pressure member 20 tightly contacts the circularly recessed portion 10*b* at the position (S) where the bending operation of the pipe (P) is initiated, and the clearance ("G" in FIG. 8) is formed between the curved surface portion 20*a* and the circularly recessed portion 10*b*, as described above, at other portions than the tip end portion. As a result, the counter pressure member 20 can be easily and appropriately assembled with the clamp member 10, which is formed by the upper section 40 and lower section 50 in this embodiment, without causing an interference with the circularly recessed portion 10*b*. As the counter pressure member 20 does not slide on the circularly recessed portion 10*b* at other portions than the tip end portion, no frictional loss will be caused, so that a durability of the counter pressure member 20 in particular will be improved. When the curved surface portion 20*a* is formed, it should be avoided to employ any arch center other than the axis (OC) as described above, because otherwise the appropriate contacting state will not be obtained. For example, if the arch center is positioned on such an axis (not shown) that is perpendicular to the plane (H) and offset in the direction spaced from the rotary axis (A), and also offset in the direction perpendicular thereto, any appropriate clearance cannot be provided.

Figure 9:
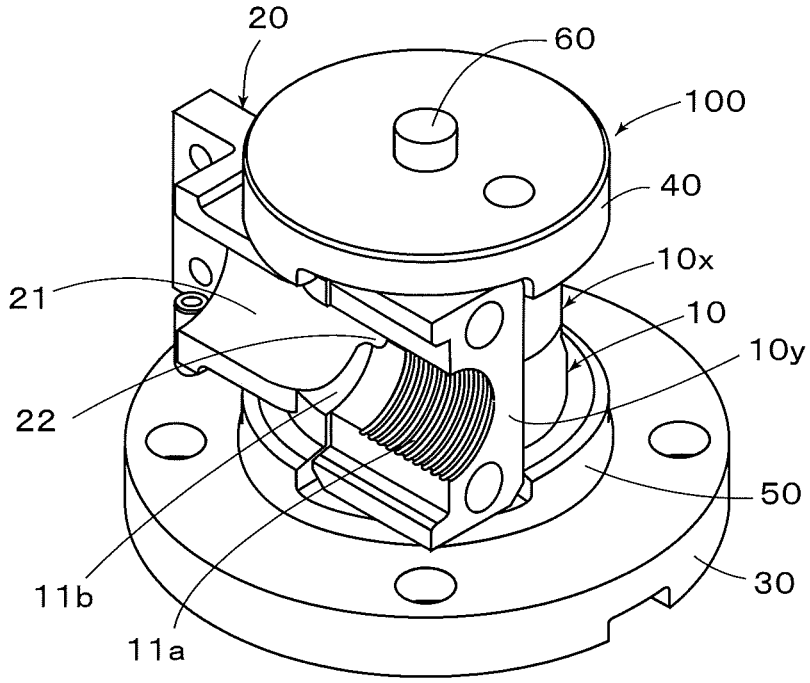
FIG. 9 is a perspective view of a pipe bend die unit showing a state thereof where a bending operation is initiated, according to an embodiment of the present invention.
Figure 10:
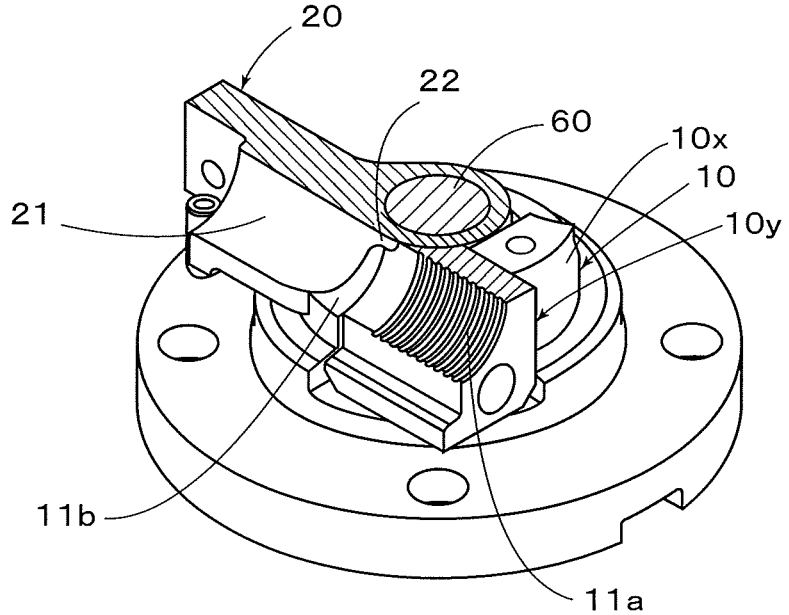
FIG. 10 is a partially sectioned perspective view of a pipe bend die unit showing a sectional view at the center of its groove bottom portion when a bending operation is initiated, according to an embodiment of the present invention.
Figure 11:
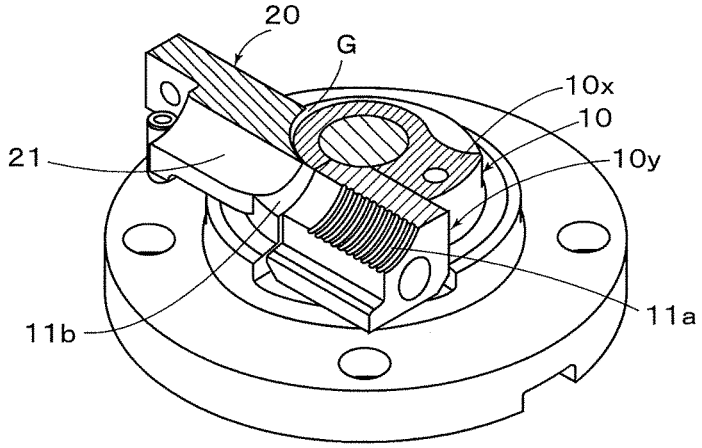
FIG. 11 is a partially sectioned perspective view of a pipe bend die unit showing a sectional view at a position spaced from the center of its groove bottom portion when a bending operation is initiated, according to a further embodiment of the present invention.
Figure 12:
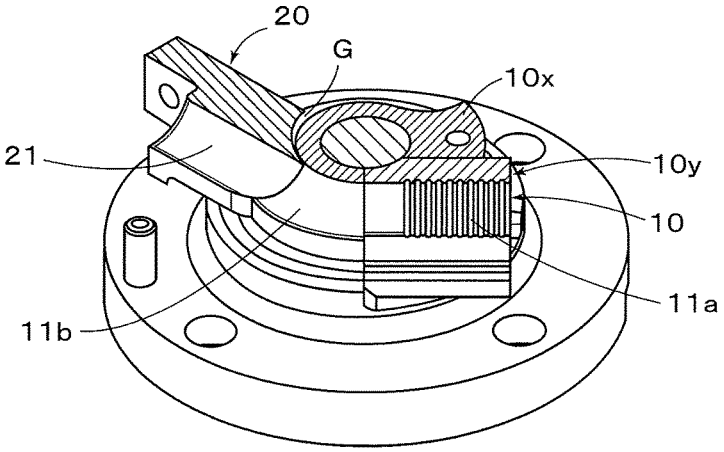
FIG. 12 is a partially sectioned perspective view of a pipe bend die unit showing a sectional view at a position spaced from the center of its groove bottom portion after a bending operation is initiated, according to an embodiment of the present invention.
Figure 13:
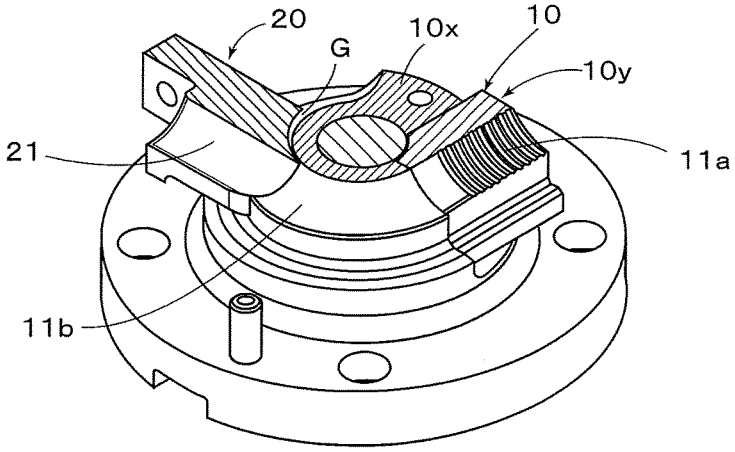
FIG. 13 is a partially sectioned perspective view of a pipe bend die unit showing a sectional view at a position spaced from the center of its groove bottom portion when a bending operation is finished, according to an embodiment of the present invention.

FIGS. 9-13 illustrate the states of relative movement between the clamp member 10 and the counter pressure member 20, with respect to the same bend die 100 as shown in FIG. 5. FIG. 9 illustrates the state where the operation is initiated, FIG. 10 illustrates the sectional view at the plane (H), and FIGS. 11-13 illustrate the sectional views at the position spaced from the plane (H), i.e., spaced from the plane including the central axis (PC) in FIG. 7 toward the reverse side (downward in FIG. 2), by the predetermined distance. As shown in FIG. 10, the tip end portion of the curved surface portion 20*a* of the counter pressure member 20 tightly contacts the circularly recessed portion 10*b*, whereas there exists the clearance (G) between the curved surface portion 20*a* and the circularly recessed portion 10*b* at other portions (positions spaced by the predetermined distance), as shown in FIGS. 11-13, even if the relative rotational angle between the clamp member 10 and the counter pressure member 20 is varied. Therefore, the counter pressure member 20 can be easily and appropriately assembled into the clamp die 10, without causing the interference with the circularly recessed portion 10*b*, and the durability of the counter pressure member 20 will be improved.

With the fitting protrusion 22 of the counter pressure member 20 as configured above being assembled as shown in FIG. 5, and positioned in the fitting recess 12 of the clamp member 10, the axial member 60 configuring the rotary axis (A) is inserted through the rotary support portion 23 to be fixed to the base portion 13, and fixed to the holding member 70, thereby to configure the bend die 100 as shown in FIG. 1. Furthermore, a knock pin 80 is fixed to a predetermined position of the base portion 13 of the clamp member 10, so that an initial relative position between the clamp member 10 and the counter pressure member 20, i.e., the position ((S) in FIG. 2) where the bending operation is initiated, is provided by a position where the counter pressure member 20 abuts on the knock pin 80.

The counter pressure member 20 of the present embodiment is supported to be rotatable about the rotary axis (A) in a direction spaced from a position where a bending operation of the pipe (P) is initiated, and held between the position where the bending operation of the pipe (P) is initiated and a predetermined retracted position to be spaced from the position where the bending operation is initiated. And, by means of the driving device (DR) as shown in FIG. 1, it is so configured that the counter pressure member 20 is held at a desired position about the rotary axis (A), in particular a desired position between the position where the bending operation is initiated and the retracted position. Consequently, the position where the bending operation of the pipe (P) is initiated, can be provided by the driving device (DR) at a desired initial position of the counter pressure member 20. While the counter pressure member 20 can be stopped by the knock pin 80 at the initial position, the counter pressure member 20 can be stopped at the initial position and held at that position, by means of the driving device (DR).

Figure 14:
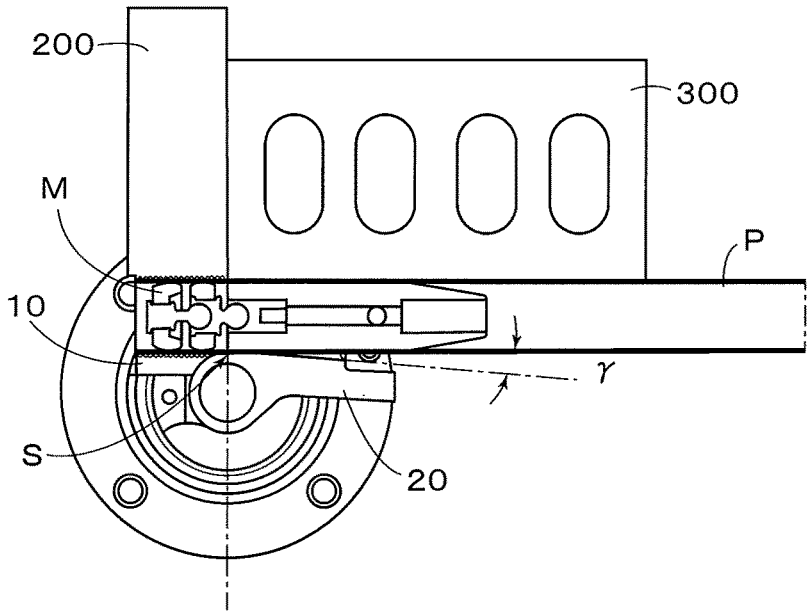
FIG. 14 is a partially sectioned plan view showing an arrangement of clamp die, pressure die, clamp member and counter pressure member at a position where a bending operation of a pipe is initiated, according to an embodiment of the present invention.
Figure 15:
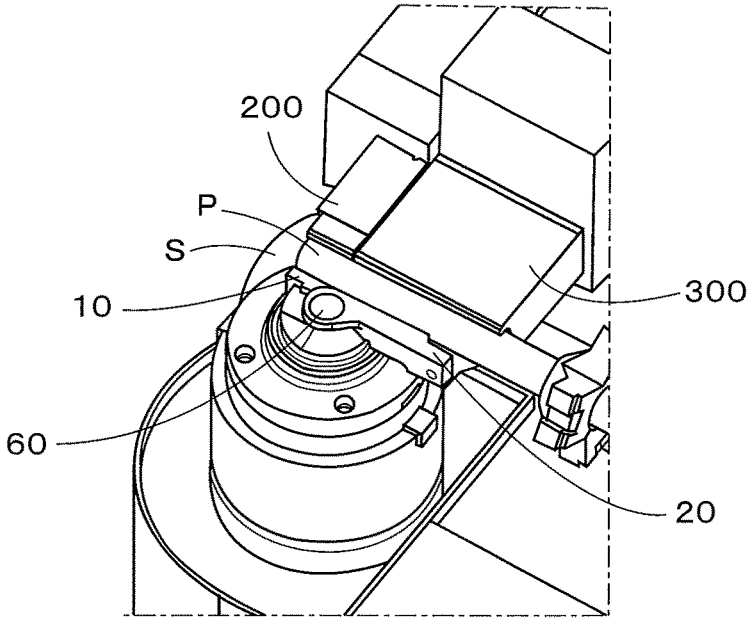
FIG. 15 is a partially sectioned perspective view showing an arrangement of clamp die, pressure die, clamp member and counter pressure member at a position where a bending operation of a pipe is initiated, according to an embodiment of the present invention.

On the other hand, the clamp die 200 and the pressure die 300 are arranged as shown in FIG. 1, and disposed to be close to or away from the bend die 100, respectively, a partially sectioned plan view and a perspective view of which are shown in FIGS. 14 and 15 (hutching is omitted to define each part clearly), and by which a relationship between the pipe (P) and the clamp member 10 and counter pressure member 20 will be made clear. Particularly, the relationship between the pipe (P) and the counter pressure member 20 at the position ((S) in FIG. 2) where the bending operation is initiated, is set as shown in FIG. 14. That is, in order that the second groove part of the counter pressure member 20 surely abuts on the outer peripheral surface of the pipe (P) at the position (S) where the bending operation is initiated, it is so arranged that the bottom center of the second groove part of the counter pressure member 20 contacts with the outer peripheral surface of the pipe (P) at the position (S) where the bending operation is initiated, whereas a small clearance is formed as being spaced from that position, so that an inclined angle (y), which is smaller than 1 degree, is provided between the bottom center of the second groove part and the outer peripheral surface of the pipe (P). On the contrary, if the counter pressure member 20 is inclined in an opposite direction to the direction as shown in FIG. 14, for example, the second groove part of the counter pressure member 20 will not abut on the outer peripheral surface of the pipe (P) at the position (S) where the bending operation is initiated, whereby a small but new crinkling may be caused.

As shown in FIGS. 1 and 2, therefore, as the pipe bend die unit is configured by the bend die 100 with the clamp member 10 and the counter pressure member 20 being placed at the initial relative position, if a plurality of pipe bend die units are provided for various shapes of the pipes (P) to be bent, in case of bending the various shapes of pipes, it is only required to select and change the bend die unit for the shape of the pipe to be bent, so that a so-called die change can be made easily. Particularly, as the position of the counter pressure member 20 where the bending operation is initiated, can be set easily and surely by the driving device (DR) and/or the knock pin 80, no adjustment after the die change is required, so that it can be adjusted easily without any skilled technique. In addition to the pipe bend die unit as described above, if an assembly is configured by further comprising the clamp die 200 and pressure die 300, it is possible to provide a pipe bend die assembly for performing the die change and adjustment easily.

Figure 6:
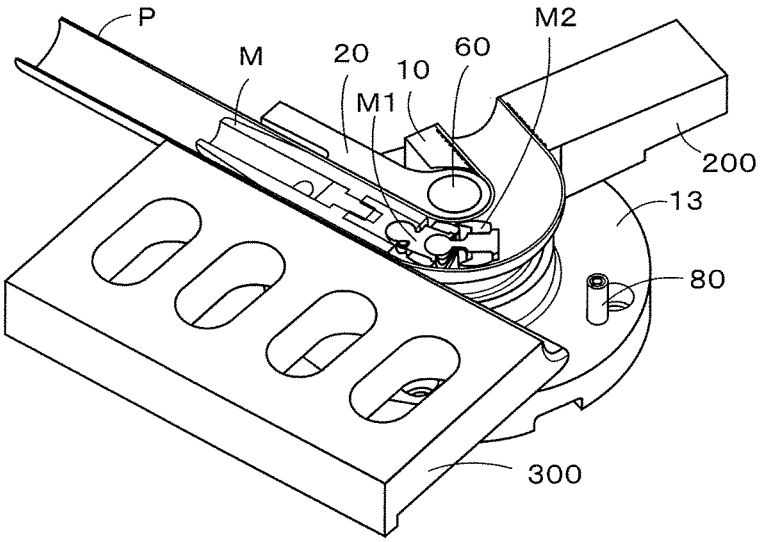
FIG. 6 is a perspective sectional view of a pipe bending apparatus showing a state where a bending operation is finished, according to an embodiment of the present invention.

Referring to FIGS. 1, 2, 6 and 16-26, the overall operation of the pipe bending apparatus having the pipe bend die unit as described above will be explained hereinafter. At the outset, in FIGS. 1, 2 and 6, with the counter pressure member 20 being held at the initial relative position to contact the knock pin 80, a portion to be bent of the body portion of the pipe (P) is placed at the position ((S) in FIG. 2) of the bend die 100 where the bending operation is initiated, a known mandrel as indicated by (M) in FIGS. 1 and 6 is inserted into the pipe (P). The mandrel (M) has balls (M1) and (M2) pivotally mounted on its tip end portion, as its cross sectional view is shown in FIG. 6, where a hutching is omitted to define each part clearly. The balls (M1) and (M2) are inserted into the pipe (P), and driven to be disposed between the bend die 100 and the clamp die 200 (and pressure die 300) within a predetermined rotating region of the bend die 100. Next, the clamp die 200 and pressure die 300 are driven toward the bend die 100, the tip end portion of the pipe (P) is clamped between the clamp member 10 of the bend die 100 and the clamp die 200, and the body portion of the pipe (P) is compressed between the counter pressure member 20 of the bend die 100 and the pressure die 300.

Then, with the tip end portion of the pipe (P) being clamped between the clamp member 10 and the clamp die 200, the pipe (P) is forwardly driven, with the body portion of the pipe (P) being pressed to the counter pressure member 20 by the pressure die 300, and also the clamp die 200 and the clamp member 10 are rotated about the rotary axis (A), so that the pipe (P) is bent to be rolled around the outer peripheral surface of the rotary support portion 23 (the outer peripheral surface 22*a* of the fitting protrusion 22), thereby to form the pipe (P) which was bent in such a shape as shown in FIG. 6. During this operation, a large pressure is applied to the pipe (P) in its longitudinal direction and radial direction. With the pipe bend die unit according to the present embodiment being employed, however, the inner side wall of the bent pipe (P) is prevented from being thickened due to its compressed deformation, and the outer side wall of the bent pipe (P) is thickened and prevented from being thinned, so that an appropriate thickness of the pipe wall can be maintained even at the bent portion.

As described before, the bend die 100 served for the pipe bend die unit of the present embodiment comprises the clamp member 10 and counter pressure member 20, which are hingedly connected about the rotary axis (A), and rotatably supported relative to each other about the rotary axis (A). Therefore, as the pipe (P) is being bent, the clamp member 10 can be rotated relatively to the counter pressure member 20 about the rotary axis (A), with the counter pressure member 20 being pressed by the pressure die 300 through the pipe (P). Consequently, the clamp member 10 is rotated from the position ((S) in FIG. 2) where the bending operation of the pipe (P) is initiated, in a circumferential direction spaced from the counter pressure member 20.

Then, the counter pressure member 10 and the clamp member 20 are connected, such that the fitting portion (indicated by (F) in FIG. 2) of the fitting recess 12 fitted with the fitting protrusion 22, which portion is not included on planar surfaces perpendicular to the rotary axis (A), is located at the foreside in the advancing direction of the pipe (P) relative to the position (S) where the bending operation of the pipe (P) is initiated, and the mating portion (indicated by (R) in FIG. 2) of the first groove part 11 of the clamp member 10 and the second groove part 21 of the counter pressure member 20 in the rotating direction is located at the backside of the advancing direction of the pipe (P), whereby a step possibly caused between the clamp member 10 and counter pressure member 20 is made small. Therefore, even if relatively large longitudinal load and compressed load comparing with the prior art are applied to the pipe (P), a plastic deformation caused by bending it can be controlled appropriately.

Figure 29:
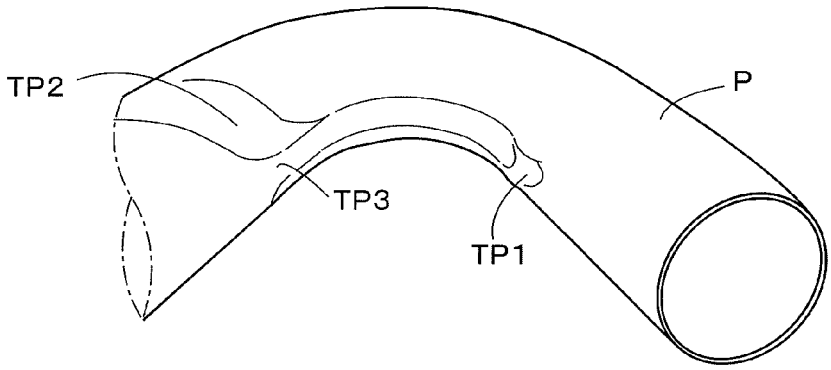
FIG. 29 is a perspective view showing a pipe which was bent by use of a pipe bend die unit according to an embodiment of the present invention.

Consequently, although the pipe (P) which was bent by use of the pipe bend die unit of the present embodiment is formed with a thick portion (protruded portion) as shown in FIG. 29 at a position corresponding to the fitting portion of the fitting recess 12 and the fitting protrusion 22, the portions next to the fitting portion will be formed in a smooth curved surface. Practically, thickness of a portion as indicated by a thin line in FIG. 29 is changed gradually, and deformed material is fitted into the fitting portion (indicated by (F) in FIG. 2) to form a thick portion (TP1), and thick portions (TP2 and TP3) along the mating portion (indicated by (R) in FIG. 2). However, the portion as indicated by the thin line in FIG. 29 is formed in a smooth curved surface, so that it does not correspond to the crinkling, and therefore, the thick portions (TP1, TP2 and TP3) may be ignored. Rather, the bent pipe with the thick portions (TP1, TP2 and TP3) being formed is proved to be the one which was formed by use of the pipe bend die unit of the present embodiment, to provide a proof of forming quality.

Figure 16:
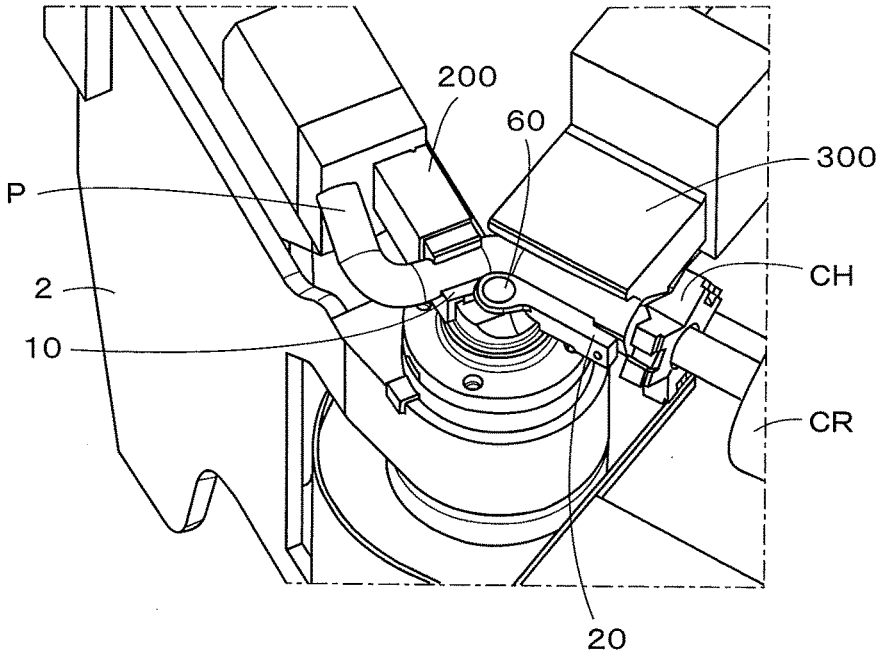
FIG. 16 is a partially sectioned perspective view showing an operating state of a pipe bending apparatus according to an embodiment of the present invention.

According to the pipe bending apparatus as described above, the bending operation of the pipe (P) is repeatedly performed by a plurality number of cycles, at one cycle of which a series of steps for the bending operation will be explained hereinafter with reference to FIGS. 16-26. According to the pipe bending apparatus of the present embodiment, as shown in FIG. 16, a pipe chuck (CH) for clamping the pipe (P) to be bent is installed, and a carriage (CR) for moving the pipe (P) forward to apply the axially pressing load is installed. By rotating (indexing) the pipe chuck (CH), a bending direction of the pipe (P) can be changed, so that a so-called three-dimensional bending can be performed. The clamp die 200 is placed on a rotary table 2, by which it is so configured to be rotated about the axial member 60 (rotary axis (A)).

Figure 17:
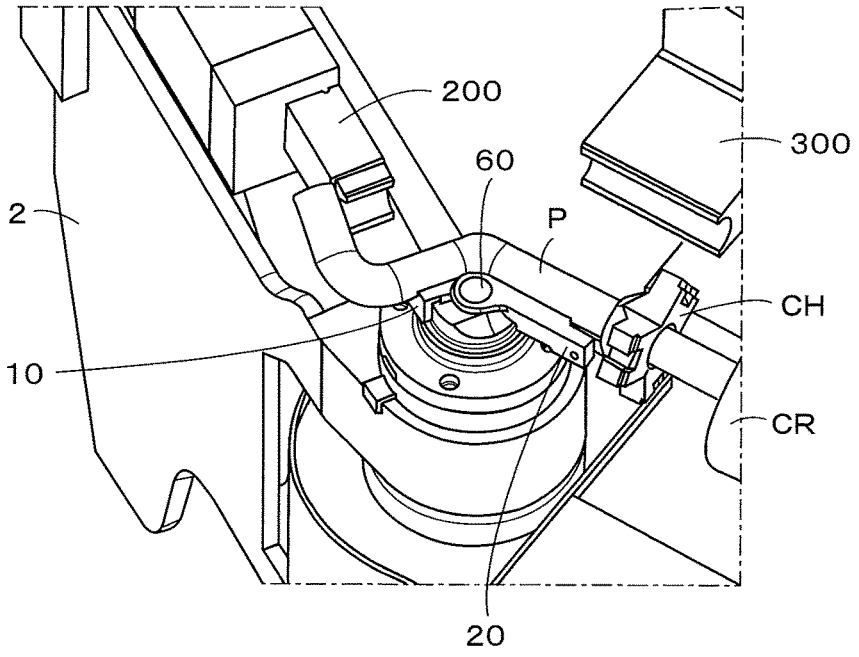
FIG. 17 is a partially sectioned perspective view showing an operating state of a pipe bending apparatus according to an embodiment of the present invention.
Figure 18:
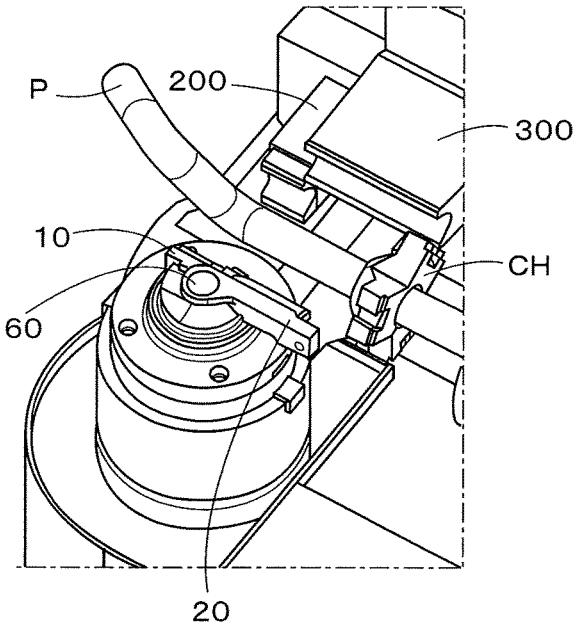
FIG. 18 is a partially sectioned perspective view showing an operating state of a pipe bending apparatus according to an embodiment of the present invention.
Figure 19:
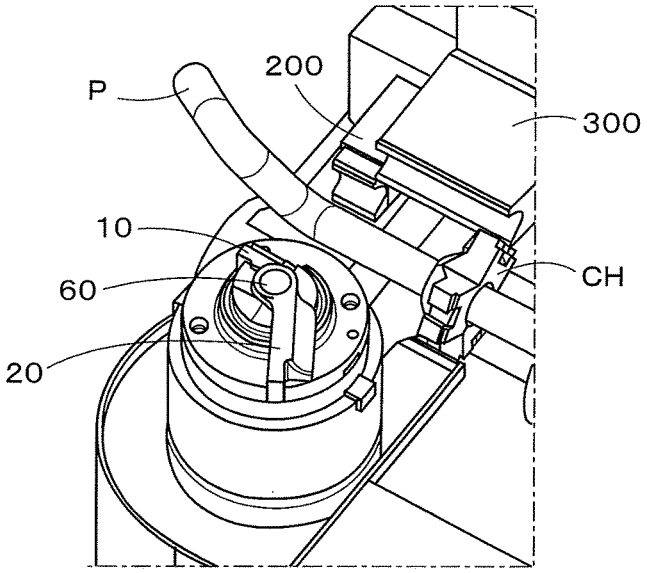
FIG. 19 is a partially sectioned perspective view showing an operating state of a pipe bending apparatus according to an embodiment of the present invention.
Figure 20:
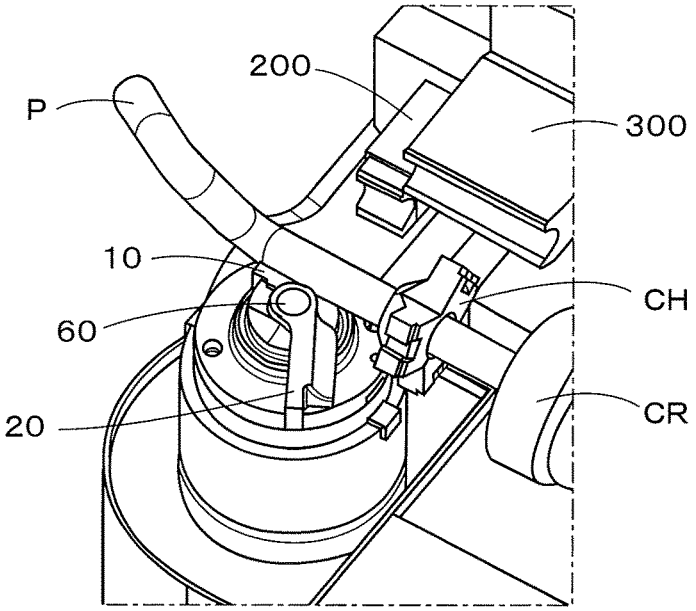
FIG. 20 is a partially sectioned perspective view showing an operating state of a pipe bending apparatus according to an embodiment of the present invention.

FIG. 16 shows a state where two cycles of the bending operation have been finished, before a final bending operation will be performed. When the clamp die 200 and pressure die 300 are driven to their retracted positions, they will be in such a state as shown in FIG. 17. Thereafter, when the clamp die 200 and pressure die 300 are returned to their origin positions as shown in FIG. 1, they will be in such a state as shown in FIG. 18. In this state, the pipe chuck (CH) is driven to be rotated, so that the bending direction of the pipe (P) is changed. That is, the pipe (P) is shifted from the state as shown in FIG. 17 to the state as shown in FIG. 18, and it is held by the pipe chuck (CH) in the latter state. Next, the counter pressure member 20 is driven by the driving device (DR) as shown in FIG. 1 to be rotated about the axial member 60 (rotary axis (A)), and held at the retracted position as shown in FIG. 19. Consequently, without the pipe chuck (CH) being interfered with the counter pressure member 20, the pipe (P) is driven by the carriage (CR) to move forward up to the position where the bending operation is initiated, as shown in FIG. 20.

Figure 21:
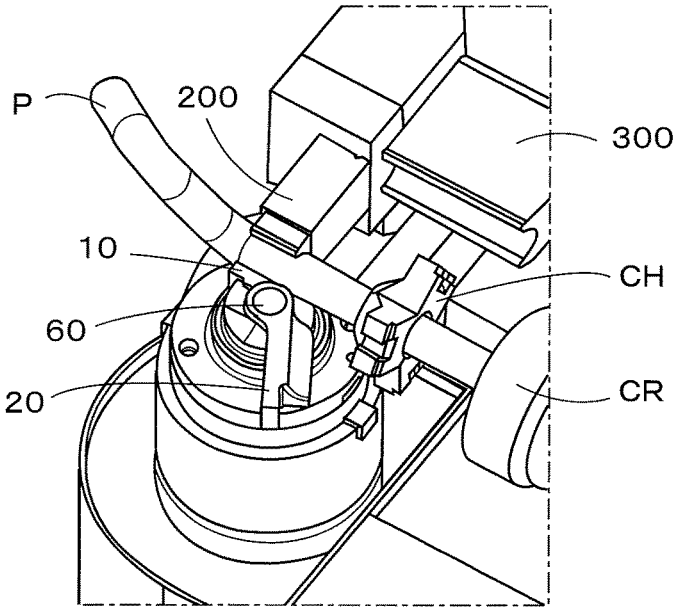
FIG. 21 is a partially sectioned perspective view showing an operating state of a pipe bending apparatus according to an embodiment of the present invention.
Figure 22:
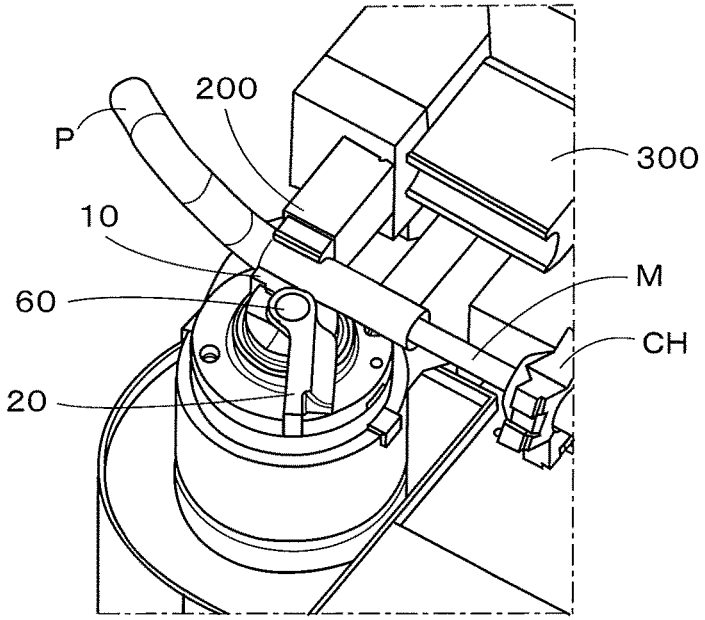
FIG. 22 is a partially sectioned perspective view showing an operating state of a pipe bending apparatus according to an embodiment of the present invention.

Next, as shown in FIG. 21, the clamp die 200 is driven to move forward, so that the pipe (P) is clamped between the clamp die 200 and clamp member 10. In this state, the pipe (P) is relieved from being held by the pipe chuck (CH). When the carriage (CR) is driven to be retracted as shown in FIG. 22, only the pipe chuck (CH) is retracted, with the pipe (P) being clamped between the clamp die 200 and clamp member 10, so that a rear shaft of the mandrel (M) is exposed in such a state as shown in FIG. 22. Supposing that the counter pressure member 20 in that state is set as the position where the bending operation is initiated, a rear end portion of the pipe (P) will be positioned to oppose the counter pressure member 20. If the carriage (CR) is driven to move forward in that state, therefore, the pipe chuck (CH) will contact (interfere) with the counter pressure member 20, whereby the bending operation will not be achieved.

Figure 23:
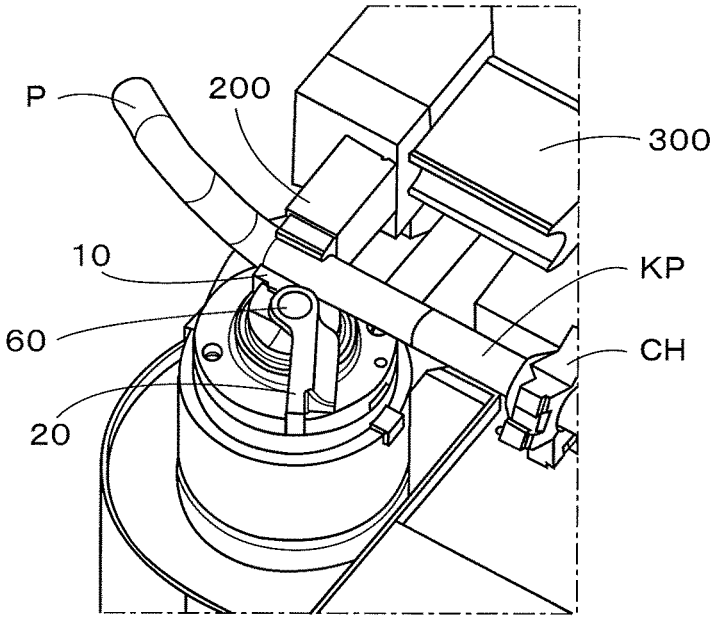
FIG. 23 is a partially sectioned perspective view showing an operating state of a pipe bending apparatus according to an embodiment of the present invention.
Figure 24:
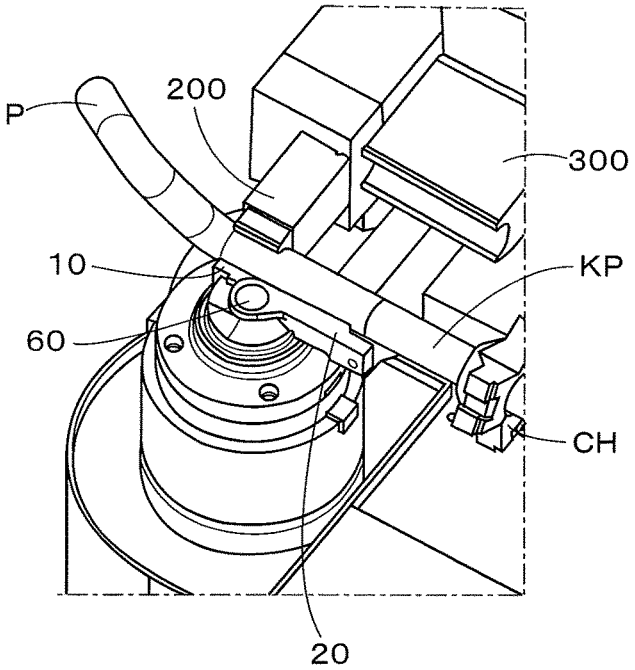
FIG. 24 is a partially sectioned perspective view showing an operating state of a pipe bending apparatus according to an embodiment of the present invention.
Figure 25:
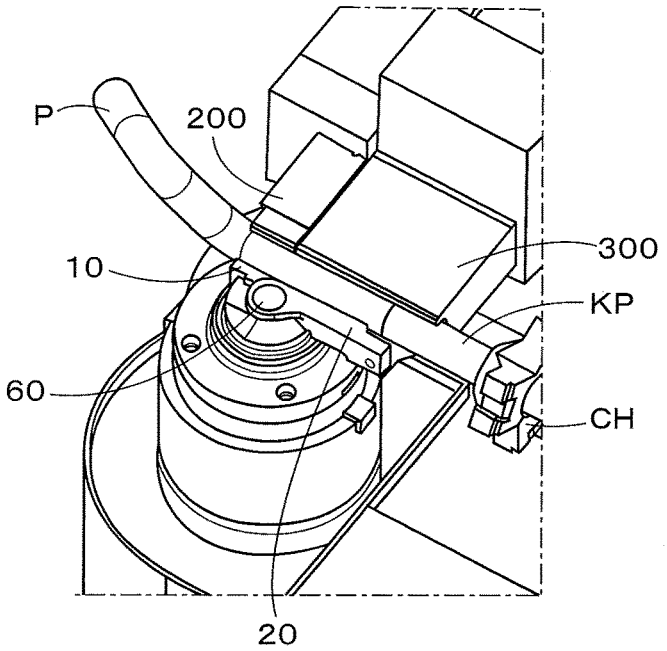
FIG. 25 is a partially sectioned perspective view showing an operating state of a pipe bending apparatus according to an embodiment of the present invention.
Figure 26:
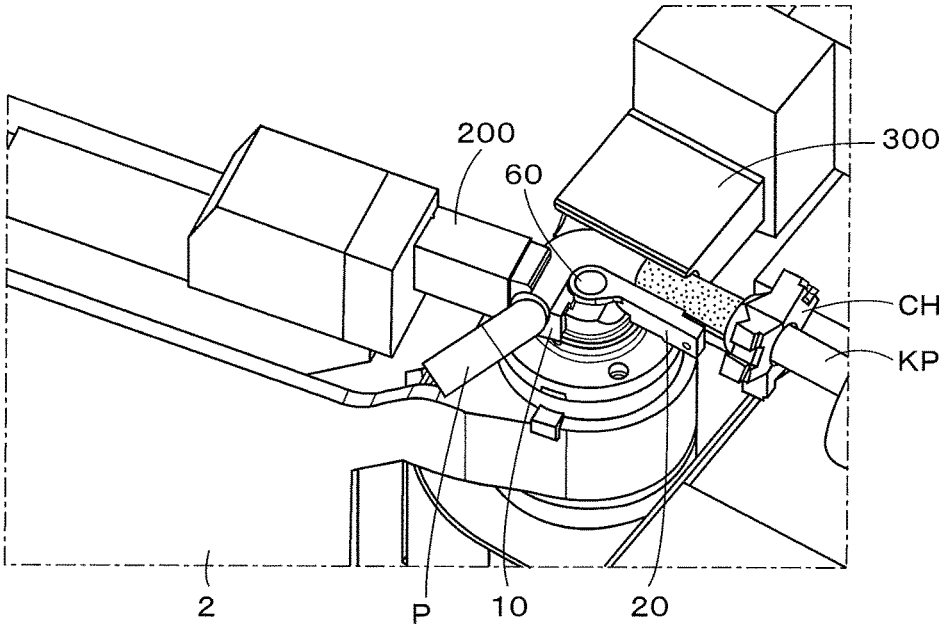
FIG. 26 is a partially sectioned perspective view showing an operating state of a pipe bending apparatus according to an embodiment of the present invention.

In view of the above, as shown in FIG. 23, it is so configured that a pipe (KP) formed in the same shape with the pipe (P), hereinafter indicated by "kick pipe (KP)", is clamped by the pipe chuck (CH), and moved forward by the carriage (CR), so that a front end of the kick pipe (KP) abuts on a rear end of the pipe (P) to enable them to move forward in a body. Then, at the position where the pipe chuck (CH) is retracted with the kick pipe (KP) as shown in FIG. 23, the counter pressure member 20 is driven by the driving device (DR) as described before, to be rotated about the axial member 60 (rotary axis (A)), and the counter pressure member 20 is held at the position where the bending operation is initiated as shown in FIG. 24. In this state, when the pressure die 300 is driven to move forward, such a state as shown in FIG. 25 that the bending operation is initiated, so that the rotary table 2 is rotated about the axial member 60 (rotary axis (A)) as shown in FIG. 26, with the pipe (P) being pressed by the pressure die 300.

Consequently, in the state that the pipe (P) is clamped between the clamp member 10 and clamp die 200, the rotary table 2 is rotated about the axial member 60 (rotary axis (A)), with the pipe (P) being pressed by the pressure die 300, and moved forward by the carriage (CR) through the kick pipe (KP), so that the compressing load and axially pressing load are applied to the pipe (P) to be bent. As a result, after the bending operation was performed to the elongated pipe (P) having a dotted portion shown in FIG. 26, which corresponds to a portion of the kick pipe (KP), it is not required to cut out the dotted portion, so that not only the cutting process is not needed, but also the yield rate of the member for configuring the pipe (P) will be improved. In addition, with the counter pressure member 20 being simply rotated about the axial member 60 (rotary axis (A)), the counter pressure member 20 can be moved easily and surely between the position where the bending operation is initiated and the retracted position, without causing any interference with the pipe chuck (CH), and held by the knock pin 80 and/or the driving device (DR) at the desired position.

Figure 27:
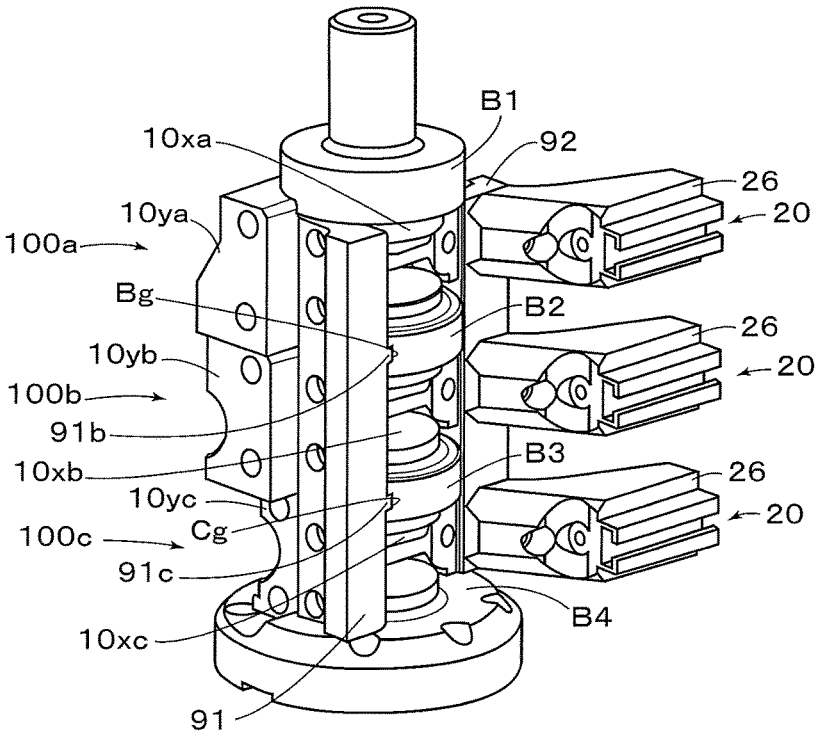
FIG. 27 is a perspective view showing a pipe bending unit according to another embodiment of the present invention.

Next, with respect to the pipe die unit, FIG. 27 shows such a multiple layers configuration that a plurality of bend dies 100*a*, 100*b* and 100*c*, each comprising the above-described clamp member 10 and counter pressure member 20, are stacked one over another, and supported to be rotatable about the rotary axis (A). The clamp member 10 and counter pressure member 20 for each die are hingedly connected with each other about the rotary axis (A), and the bend dies 100*a*, 100*b* and 100*c* are configured by four members B1-B4 (and the axial member 60) to provide main bodies 10*xa*, 10*xb* and 10*xc* of three clamp members, to which are connected clamp portions 10*ya*, 10*yb* and 10*yc*, which are formed in shapes in accordance with forming states of the pipe (P) to be clamped, respectively. On a tubular portion of the member B2, an engaging groove (Bg) is formed perpendicularly to the rotary axis (A). Also, on a tubular portion of the member B3, an engaging groove (Cg) is formed perpendicularly to the rotary axis (A). And, protrusions 91*b*, 91*c* to be engaged with those grooves are formed on the connecting support member 91.

Consequently, the members B1-B4 are connected to the connecting support member 91 by bolts or the like at the opposite sides to the positions of the clamp members, where the bending operation is initiated, and the protrusions 91*b*, 91*c* are engaged with the engaging grooves Bg, Cg, to be firmly held by a so-called spigot joint structure. That is, the members B2 and B3 configuring the bend die have the engaging grooves Bg, Cg formed in parallel with the planar surface perpendicular to the rotary axis (A), and the connecting support member 91 has protrusions 91*b*, 91*c* to be engaged with the engaging grooves Bg, Cg, respectively, by which the main bodies 10*xa*, 10*xb* and 10*xc* of the clamp members are firmly held. The counter pressure members 20 (xa, xb and xc are omitted hereinafter) corresponding to the main bodies 10*xa*, 10*xb* and 10*xc* are connected by bolts or the like to a connecting support member 92, through a support member 26.

Figure 28:
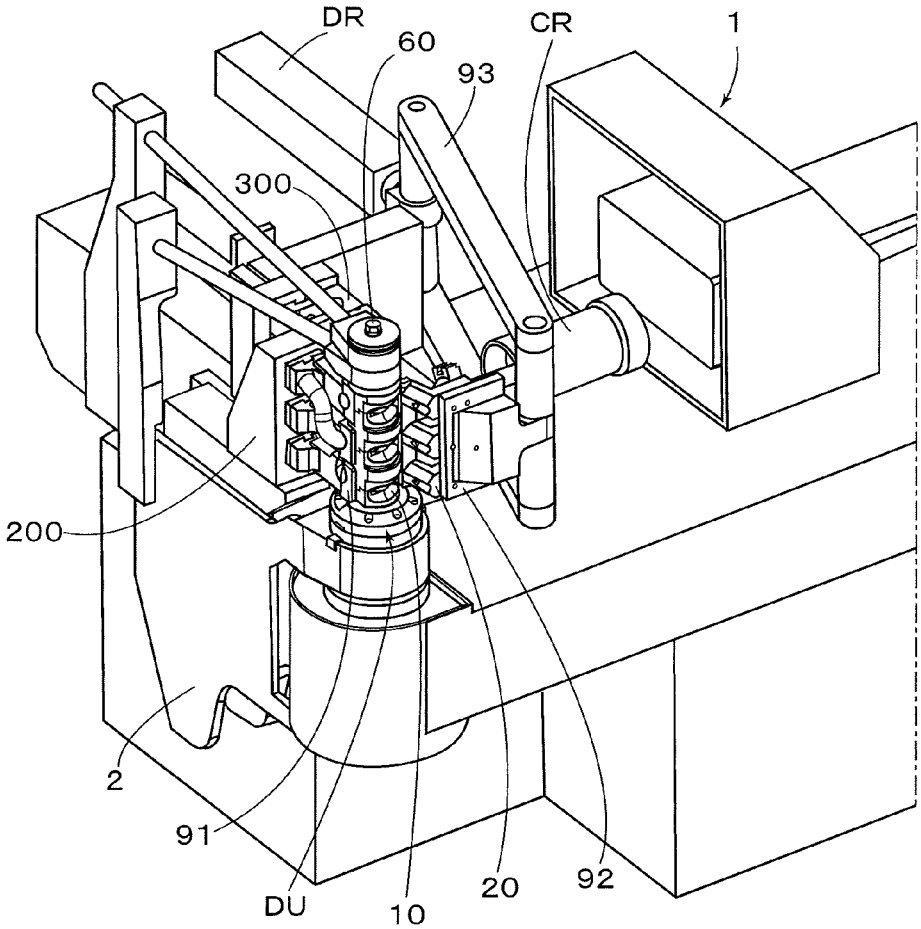
FIG. 28 is a perspective view showing a pipe bending apparatus according to another embodiment of the present invention.

Then, as shown in FIG. 28, the pipe bending apparatus 1 of the present embodiment comprises the rotary table 2, carriage (CR), clamp die 200, pressure die 300 and so on as shown in FIG. 16 and so on, and a pipe bend die unit as indicated by (DU) in FIG. 27 is installed. And, it is so configured that the connecting support members 91 and 92 are rotated about the rotary axis (A), so as to control movement of the three clamp members 10 and counter pressure members 20. According to the present embodiment, the connecting support member 92 is connected to the driving device (DR) through a link 93, so that three counter pressure members 20 are configured to move simultaneously. However, it may be so configured that the three clamp members 10 and counter pressure members 20 are controlled to move separately.

As described above, according to the pipe bending apparatus having the pipe bend die unit of the present embodiment, a smooth bending can be achieved without causing a crinkling. In other words, by appropriately controlling the plastic forming caused by the bending operation appropriately, the bending of the pipe (P) can be achieved appropriately without causing the crinkling. Consequently, provided that a diameter of a pipe (P) is "d" and a bending radius is "r", for example, a pipe (P) with such an extraordinarily small bending radius that "r/d" is smaller than 1 can be easily formed. As an alternative to the aforementioned pipe bending apparatus, it may be so configured that the clamp member 10 is fixed, and that the counter pressure member 20 is rotated about the rotary axis (A). Furthermore, the pipe bend die unit can be used for an automatic pipe bending apparatus, and an automatic die change can be performed by a robot.

According to the above-described pipe bending apparatus, it may be so configured to watch a pressure applied to a bending inner side of the pipe (P) to be bent, and control the bending operation in accordance with the watching result. For example, it may be provided with a pressure sensor (PS) for detecting a pressure applied to the fitting recess 22 of the counter pressure member 20, by controlling the compressing load of the pressure die, or adjusting the angle of the counter pressure member 20 in accordance with the detected result, the crinkling of the pipe (P) may be minimized appropriately, and breaking or buckling can be prevented. With respect to the arrangement of the counter pressure member 20, as shown in FIG. 14, such an initial setting has been set that the inclined angle (y) provided between the bottom center of the second groove part 21 and the outer peripheral surface of the pipe (P) is smaller than 1 degree. The inclined angle (y) may be adjusted in accordance with the detected result of the pressure sensor (PS), within a range smaller than 1 degree, according to a configuration as explained hereinafter.

Figure 30:
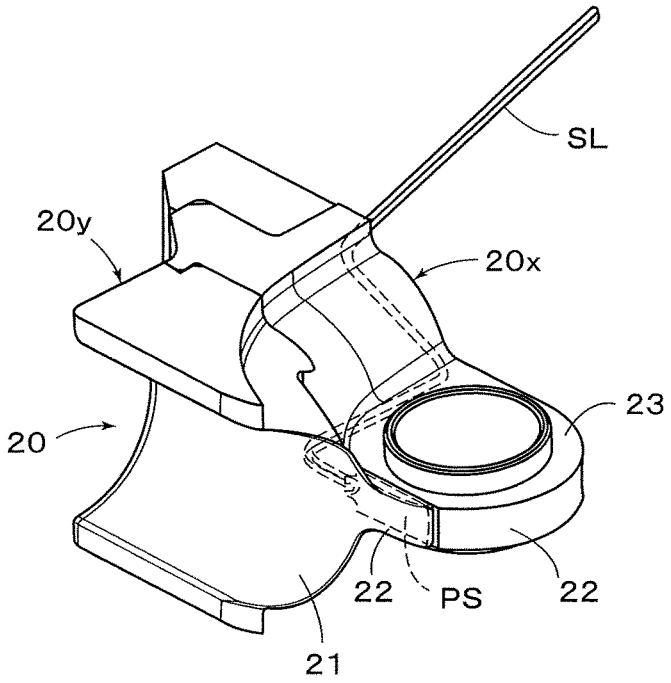
FIG. 30 is a perspective view showing another embodiment of a counter pressure member for use in a pipe bending unit and a pipe bending apparatus according to the present invention.
Figure 31:
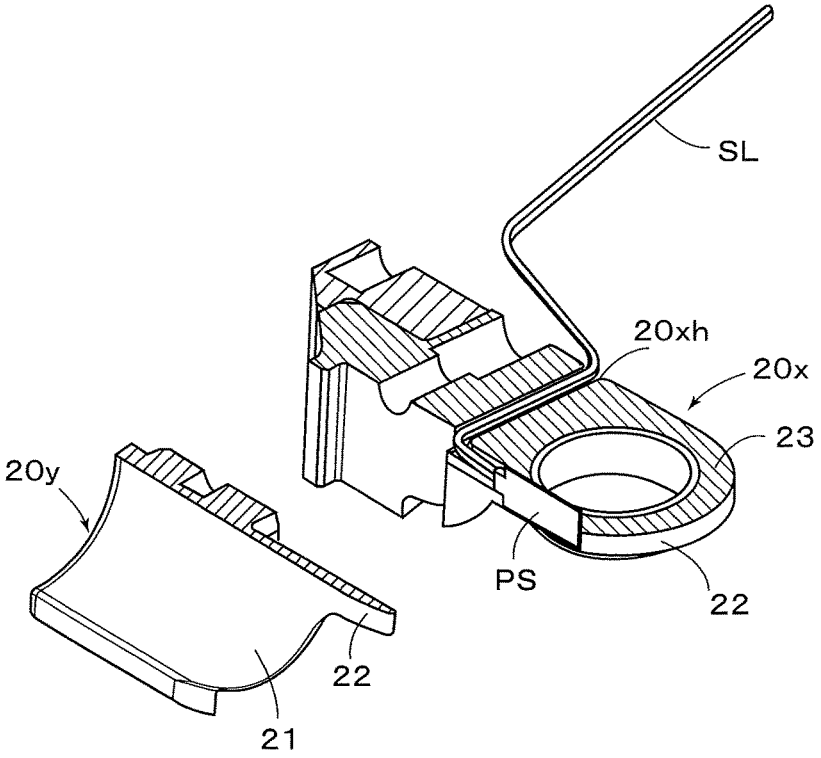
FIG. 31 is a perspective sectional view showing a sectional view of the counter pressure member as shown in FIG. 30, which is divided into two parts.
Figure 32:
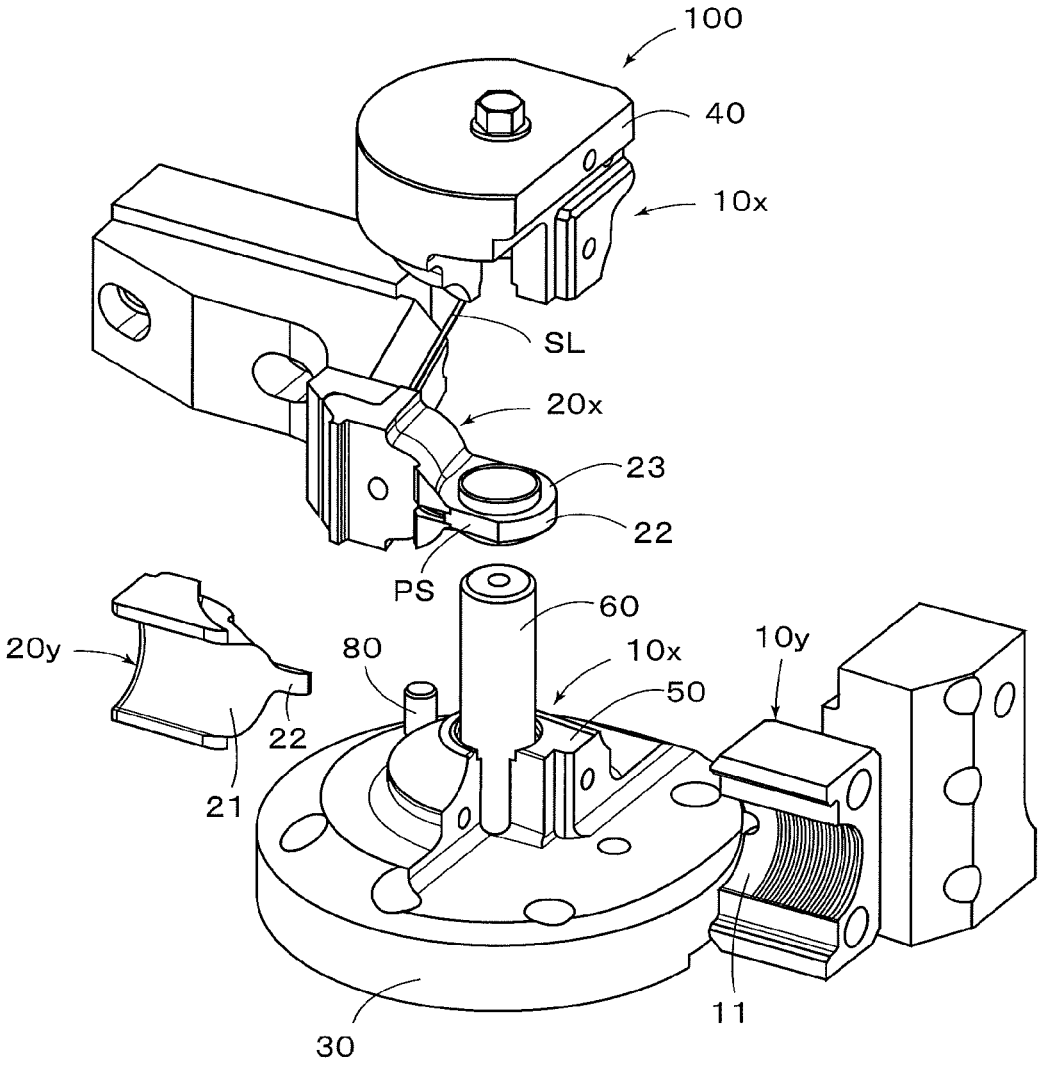
FIG. 32 is a perspective view of parts for assembling a pipe bend die unit having the counter pressure member as shown in FIG. 30.

At the outset, as shown in FIGS. 30-32, the counter pressure member 20 is divided into a first member 20*x* which configures the rotary support portion 23, and a second member 20*y* which configures the second groove portion 21 and the fitting protrusion 22, and it is so configured that only the second member 20*y* which includes a likely worn part can be replaced. In addition, a sheet like pressure sensor (PS) is disposed between the first member 20*x* and second member 20*y*, so that its lead wire (SL) can be drawn from a through hole 20*xh* (shown in FIG. 31) formed in the first member 20*x*. As for the pressure sensor (PS), for example, a piezo film may be employed appropriately, while other gages or the like may be employed, provided that they configure such a pressure sensing element that can be made thin with its strength being maintained, and that can detect pressures in a relatively broad range, such as the piezo film. With respect to other configuration, it is the same as the configuration as shown in FIG. 5, so that its explanation is omitted herein, with the same reference numerals given to substantially the same numerals as described before.

Figure 33:
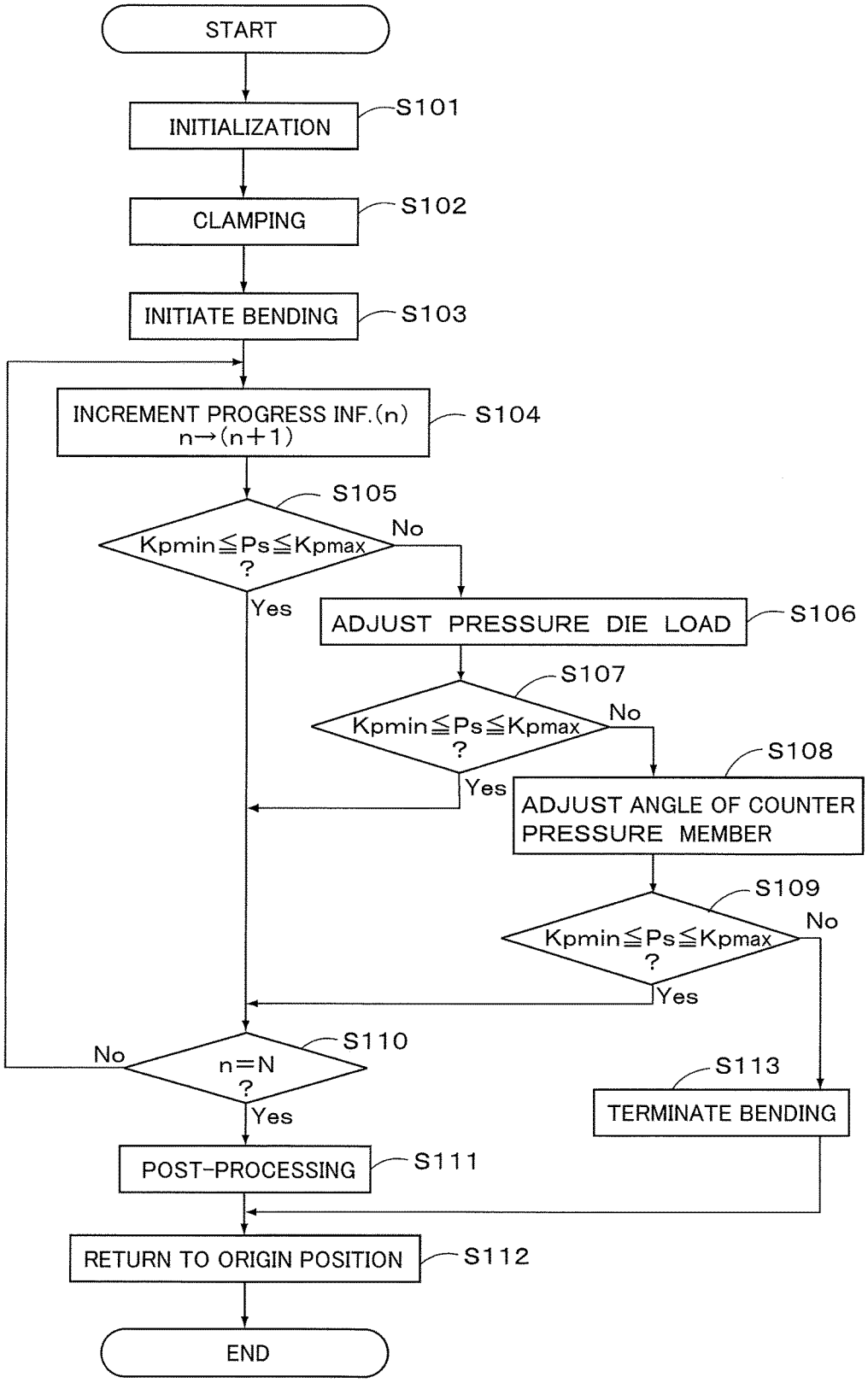
FIG. 33 is a flow chart showing an example of controlling a pipe bending apparatus having the pipe bend die unit as shown in FIG. 32.

FIG. 33 is a flow chart showing an example of controlling the bending operation by means of the pipe bending apparatus having the pipe bend die unit as shown in FIG. 32. At Step S101, initial values for the clamp member 10, clamp die 200, pressure die 300 and so on are set, and, at Step S102, the clamp die 200, pressure die 300 and so on are actuated to be clamped and pressurized. At Step S103, the bending operation is initiated as described before. After an operating progress information (n), which indicates a progress state of the bending operation, is incremented at Step S104, the program proceed to Step S105. The operating progress information (n) is provided in accordance with an operation period or rotational angle of the clamp member 10 (and clamp die 200), so that it corresponds to an index for indicating a progress state of an operation loop which is repeated every predetermined interval.

At Step S105, it is determined whether a pressure (Ps) of the result detected by the pressure sensor (PS) is within a range, which is equal to or greater than a minimum value (Kpmin) and which is equal to or smaller than a maximum value (Kpmax). If it is determined that the pressure (Ps) is within the range to be normal, the program proceeds to Step S110 as it is, whereas if it is determined that the pressure (Ps) is out of the range, the program proceeds to Step S106, where the load applied by the pressure die 300 is adjusted. Thereafter, it is determined at Step S107 whether the pressure (Ps) is within the range, or not. If it is determined that the pressure (Ps) is within the range, the program proceeds to Step S110 as it is, whereas if it is determined that the pressure (Ps) is out of the range, the program further proceeds to Step S108, where a control for adjusting the angle of the counter pressure member 20 is performed.

That is, the inclined angle (y) as shown in FIG. 14 between the bottom center of the second groove part 21 of the counter pressure member 20 and the outer peripheral surface of the pipe (P) is so controlled to be reduced according to the detected result of the pressure sensor (PS), i.e., to be close to 0 within the range of 1 degree, and adjusted to an appropriate inclined angle so as to prevent the crinkling from being caused. As a result, if it is determined at Step S109 that the pressure (Ps) is within the range, which is equal to or greater than the minimum value (Kpmin) and which is equal to or smaller than the maximum value (Kpmax), the program proceeds to Step S110 as it is, whereas if it is determined that the pressure (Ps) is out of the range, after the bending operation is terminated at Step S113, the program proceeds to Step S112, where the clamp die 200, pressure die 300 and so on are returned to their origin positions. Consequently, in the case where the crinkling is likely created, the bending operation is terminated, so that the pipe (P) will not be broken.

Accordingly, the above-described bending operation is repeated until it is determined at Step S110 that the operating progress information (n) has reached to a predetermined operating progress information (N). After the bending operation is terminated, a post-processing (such as clearing various memories or the like) is performed at Step S111, then the clamp die 200, pressure die 300 and so on are returned to their origin positions at Step S112.

Figure 34:
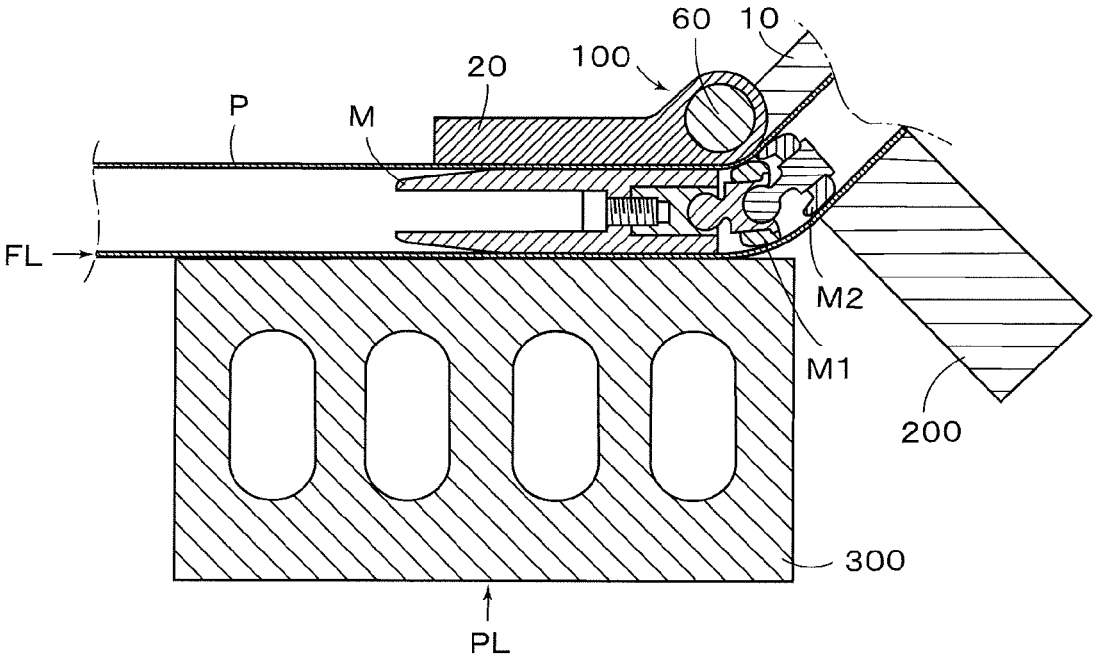
FIG. 34 is a sectional view showing a pipe bending state of a pipe bending apparatus using a pipe bend die unit according to an embodiment of the present invention.

According to the present invention, it is so configured that the bend die 100 of the aforementioned embodiment, especially the counter pressure member 20 hingedly connected to the clamp member 10 functions effectively, so as to be capable of opposing the large load by the pressure die 300 sufficiently. As shown in FIG. 34, axially pressing load (indicated by "FL") and compressing load (indicated by "PL") are applied to the pipe (P). According to the present embodiment, sufficient pressure proof strength against the large load by the pressure die 300 can be ensured, because the clamp member 10 and the counter pressure member 20 are hingedly connected as shown in FIG. 2, such that the fitting portion (F) of the fitting recess 12 fitted with the fitting protrusion 22, which portion (F) is not included in the planar surfaces perpendicular to the rotary axis (A), is located at the foreside in an advancing direction of the pipe (P) relative to the position (S) where the bending operation is initiated, and the mating portion (R) of the first groove part 11 of the clamp member 10 and the second groove part 21 of the counter pressure member 20 is located at the backside of the advancing direction of the pipe (P). Furthermore, in such a state that the mandrel (M) (ball mandrels M1 and M2) is inserted into the pipe (P), the compressing load (PL) applied to the pipe (P) can be made larger, so that the bending radius of the pipe (P) can be made minimum.

Figure 35:
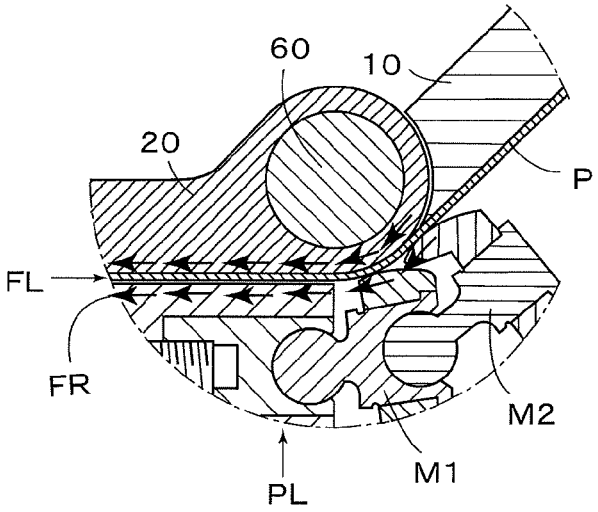
FIG. 35 is a sectional view enlarging a part of FIG. 34.

Also, as enlarged in FIG. 35, in order to avoid reduction of thickness at the outer side of the pipe (P) caused by bending the pipe (P), it is so configured that the axially pressing load (FL) is applied to the pipe (P), so that the pipe (P) is fed with material, thereby to enlarge its thickness. At the inner side of the pipe (P) to be bent, however, a friction force (indicated by a leftward arrow "FR" in FIG. 35) is caused by the compressing load (PL) against the axially pressing load (FL), so that the thickness will be increased by that friction force (FR). Furthermore, if the axially pressing load (FL) is applied in the state that the mandrel (M) has been inserted into the pipe (P), the pipe (P) is advanced (moved to the rightward in FIG. 35) in such a state as being compressed between the mandrel (M) and the counter pressure member 20, so that the thickness will be more largely increased, with squeezing operation being added by both of the members.

Figure 36:
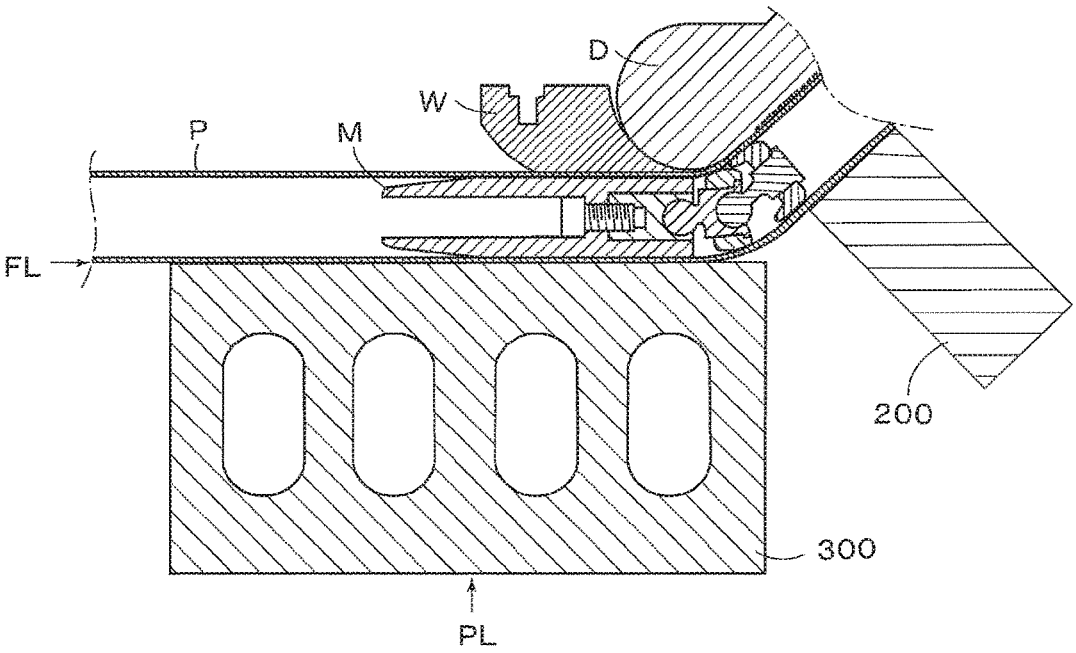
FIG. 36 PRIOR ART
FIG. 36 is a sectional view showing a pipe bending state of a rotary drawing bend apparatus having a prior bend die and a wiper.

In contrast, according to the rotary draw bending apparatus using the prior bend die and wiper for preventing the crinkling, it is arranged in such a manner that the wedge shaped wiper (W) will squeeze into a clearance between the pipe (P) and bend die (D) as shown in FIG. 36, the tip end of the wiper (W) is made extremely thin, so as to reduce the clearance between the pipe (P) and wiper (W) as small as possible, so that the wiper (W) is likely to be fragile. Therefore, if the large load by the pressure die 300 is continuously applied to the wiper (W), its tip end will be deformed or destroyed, to enlarge the clearance between the same and the pipe (P), thereby to cause the crinkling. In order to avoid the crinkling, it is required to maintain the extremely thin tip end of the wiper (W), so that a periodical change of the wiper (W) and a change for a destroyed one have been necessarily required. Also, as the pipe is bent to avoid the crinkling from being caused, the radius of the pipe (P) to be bent is limited, so that the maximum radius of the pipe (P) to be made will be approximately 2 of the aforementioned r/d ratio, at most.

Figure 37:
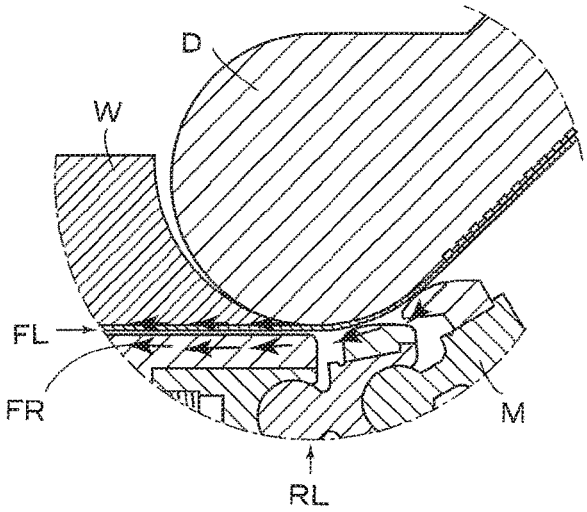
FIG. 37 PRIOR ART
FIG. 37 is a sectional view enlarging a part of FIG. 36.

According to the prior rotary draw bending apparatus as described above, although the bending of the pipe (P) is performed in the state that the mandrel (M) has been inserted into the pipe (P), and the friction force (FR) is caused as shown in FIG. 37, no sliding motion is made between the pipe (P) and bend die (D) basically, but a following motion of the pipe (P) is made in response to rotating motion of the bend die (D), so that increase of the thickness cannot be expected by the friction force (FR). FIGS. 36 and 37 are prepared to simply show operation and effect according to the prior art, to be compared with the operation and effect according to the present invention using the pipe bend die unit. FIGS. 36 and 37 are not intended to imply that such known apparatuses are comparable to the pipe bend die unit of the present invention.

DESCRIPTION OF CHARACTERS

10 clamp member
10*a* clamp portion
10*b* circularly recessed portion
10*x*, 10*xa*, 10*xb*, 10*xc* main body
10*y*, 10*ya*, 10*yb*, 10*yc* clamp portion
11, 11*a*, 11*b* first groove part
12 fitting recess
13 base portion
20 counter pressure member
20*a* curved surface portion
21 second groove part
22 fitting protrusion
23 rotary support portion
26 support member
30 base
40 upper section
50 lower section
60 axial member
70 holding member
80 knock pin
91, 92 connecting support member
100, 100*a*, 100*b*, 100*e* bend die
200 clamp die
300 pressure die
A rotary axis
P pipe
DR driving device
M mandrel

The invention claimed is:

1. A pipe bend die unit comprising a bend die with a pipe-receiving groove of half-circular cross section formed on an outer peripheral surface of the bend die, the bend die being rotatable about a rotary axis, and the bend die comprising:

a clamp member having a first groove part of half-circular cross section on an outer peripheral surface of the clamp member with a fitting recess formed on the first groove part and extending in a peripheral direction by a first predetermined length on a planar surface perpendicular to the rotary axis; and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another about the rotary axis, and supported so as to be rotatable relative to each other about the rotary axis, and the counter pressure member being supported to be rotatable about the rotary axis in a direction spaced from a position where a bending operation of the pipe is initiated, and held between the position where the bending operation of the pipe is initiated and a predetermined retracted position to be spaced from the position where the bending operation is initiated.

2. The pipe bend die unit of claim 1, wherein one part of the fitting protrusion is located at a foreside in an advancing direction of the pipe relative to the position where the bending operation of the pipe is initiated, and an other part of the fitting protrusion is located at a backside in the advancing direction of the pipe relative to the position where the bending operation of the pipe is initiated.

3. The pipe bend die unit of claim 1, wherein a fitting portion of the fitting protrusion that is positioned in the fitting recess is located at a foreside in an advancing direction of the pipe relative to the position where the bending operation of the pipe is initiated, and a mating portion at which the first groove part of the clamp member and the second groove part of the counter pressure member mate is located at a backside in the advancing direction of the pipe relative to the position where the bending operation of the pipe is initiated.

4. The pipe bend die unit of claim 1, wherein the counter pressure member has an annular rotary support portion mounted to be rotatable about the rotary axis, and wherein a part of the rotary support portion forms the fitting protrusion, and the rotary support portion possesses an outer peripheral surface, the outer peripheral surface of the rotary support portion being a curved surface forming a part of the pipe-receiving groove of half-circular cross section.

5. The pipe bend die unit of claim 1, wherein the counter pressure member and the clamp member are hingedly connected by an axial member having a central axis passing through the fitting recess.

6. The pipe bend die unit of claim 1, wherein the position where the bending operation of the pipe is initiated is provided to be a desired initial position of the counter pressure member.

7. The pipe bend die unit of claim 1, further comprising a driving device that holds the counter pressure member at a desired position between the position where the bending operation is initiated and the retracted position.

8. A pipe bending apparatus comprising:

a bend die having a pipe-receiving groove of half-circular cross section on an outer peripheral surface of the bend die, the bend die being rotatable about a rotary axis;

a clamp die for clamping a pipe to be bent that is positioned in the pipe-receiving groove of the bend die; and a pressure die for pressing the pipe toward the bend die, wherein the bend die comprises:

a clamp member having a first groove part of half-circular cross section on an outer peripheral surface of the clamp member with a fitting recess formed on the first groove part and extending in a peripheral direction by a first predetermined length on a planar surface perpendicular to the rotary axis; and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another about the rotary axis, and supported so as to be rotatable relative to each other about the rotary axis, and the counter pressure member being supported to be rotatable about the rotary axis in a direction spaced from the position where the bending operation of the pipe is initiated, and held between the position where the bending operation of the pipe is initiated and a predetermined retracted position to be spaced from the position where the bending operation is initiated, to configure a pipe bend die unit.

9. The pipe bending apparatus of claim 8, wherein one part of the fitting protrusion is located at a foreside in an advancing direction of the pipe relative to the position where the bending operation of the pipe is initiated, and an other part of the fitting protrusion is located at a backside in the advancing direction of the pipe relative to the position where the bending operation of the pipe is initiated.

10. The pipe bending apparatus of claim 8, wherein the counter pressure member has an annular rotary support portion mounted to be rotatable about the rotary axis, and wherein a part of the rotary support portion forms the fitting protrusion, and the outer peripheral surface of the rotary support portion is a curved surface forming a part of the pipe-receiving groove of half-circular cross section.

11. The pipe bending apparatus of claim 8, wherein the position where the bending operation of the pipe is initiated is provided to be a desired initial position of the counter pressure member.

12. The pipe bending apparatus of claim 8, further comprising a driving device that holds the counter pressure member at a desired position between the position where the bending operation is initiated and the retracted position.

13. The pipe bending apparatus of claim 8, further comprising a mandrel with a tip end portion thereof being inserted into the pipe, the mandrel being driven such that the tip end portion opposes the pressure die within a predetermined rotating region of the bend die.

* * * * *